US008425074B2

(12) United States Patent
Tsai

(10) Patent No.: US 8,425,074 B2
(45) Date of Patent: Apr. 23, 2013

(54) TOOL CAPABLE OF TURNING ON/OFF A LIGHT AUTOMATICALLY

(76) Inventor: Cheng-Chien Tsai, Taichung (TW)

( * ) Notice: Subject to any disclaimer, the term of this patent is extended or adjusted under 35 U.S.C. 154(b) by 586 days.

(21) Appl. No.: 12/696,022

(22) Filed: Jan. 28, 2010

(65) Prior Publication Data

US 2011/0182058 A1 Jul. 28, 2011

(51) Int. Cl.
*B25B 13/00* (2006.01)
*B25B 13/46* (2006.01)

(52) U.S. Cl.
USPC ..... 362/119; 362/120

(58) Field of Classification Search ..... 362/119–120, 362/203, 208
See application file for complete search history.

(56) References Cited

U.S. PATENT DOCUMENTS 5,477,434 A * 12/1995 Reed ..... 362/119
6,367,944 B1 * 4/2002 Wang ..... 362/119
2008/0158861 A1 * 7/2008 Chiang ..... 362/120

* cited by examiner

*Primary Examiner* — Karabi Guharay
(74) *Attorney, Agent, or Firm* — Raymond Y. Chan; David and Raymond Patent Firm

(57) ABSTRACT

A tool capable of turning on/off a light automatically comprises a body including a fitting area in response to a fitted tool and a receiving groove disposed therein to communicate with a font end thereof; a light module installed in the receiving groove and including at least one bulb and a cell set, a first electrode of the cell set connecting with a first connecting leg of the bulb, and a second electrode of the cell set connecting contacting with the fitting area of the body, and when the fitting area of the body is fitted to a fitted tool, a second connecting leg of the bulb conducting to the second electrode of the cell set.

10 Claims, 22 Drawing Sheets

TOOL CAPABLE OF TURNING ON/OFF A LIGHT AUTOMATICALLY

BACKGROUND OF THE PRESENT INVENTION

1. Field of Invention

The present invention relates to a tool capable of turning on/off a light automatically that is capable of turning on/off the bulb easily and assembling and disassembling the locking member conveniently.

2. Description of Related Arts

Referring to FIG. 1, a conventional socket ratchet wrench 1 to match with various sizes of sockets 6 comprises a handle 2 disposed on a rear end thereof and a driving head 3 with a ratchet device mounted on a front end thereof, and the driving head 3 includes a polygonal post 4 fixed on a lower side thereof, and the post 4 includes a retaining ball 5 attached on one side thereof to engage a socket 6. The socket 6 includes a polygonal fitting end 7 disposed on one end thereof to fit the post 4, and includes a polygonal working end 8 mounted on another end thereof to fit with a locking member to assemble or disassemble a workpiece. To assemble and disassemble the workpiece in a dim and narrow space, the user has to hold a flashlight with one hand and hold a tool with another end, causing an inconvenient operation.

With reference to FIG. 2, an improved socket ratchet wrench 10 comprises a driving head 11 having a bulb 12 disposed on a lower side thereof, and having a switch 13 installed on a suitable position thereof to turn on the bulb so as to illuminate and assemble or disassemble a workpiece, however such an improved wrench has the following disadvantages:

1. The driving head 11 of the socket ratchet wrench 10 includes many driving elements received therein, therefore its space is limited that has to increase the size to install the bulb 12 and a cell set, having an oversized driving head.
2. The bulb 12 is installed on a lower side of the driving head 11, and the driving head 11 is located at one side of a post 14. After the post 14 is fitted to the socket, the socket will shield partial lights of the bulb 12 without illuminating the locking member directly, having poor illumination.
3. The bulb 12 is turned on by using the switch 13, hence having an inconvenient operation, and if the user forgets turning off the bulb, a power consumption will occur.

The present invention has arisen to mitigate and/or obviate the afore-described disadvantages.

SUMMARY OF THE PRESENT INVENTION

The primary object of the present invention is to provide a tool capable of turning on/off a light automatically that is capable of turning on/off the bulb easily and assembling and disassembling the locking member conveniently.

Further object of the present invention is to provide a tool capable of turning on/off a light automatically that the light illuminates to a desired position of a locking member without being stopped by an obstacle, thereby assembling and disassembling the locking member conveniently.

Another object of the present invention is to provide a tool capable of turning on/off a light automatically that after finishing the disassembling process, user disengages the tool from the fitting area of the body so that a break between the second electrode of the cell set and the second connecting leg of the bulb generates to turn off the bulb automatically, thereby saving power.

In accordance with the present invention, there is provided a tool capable of turning on/off a light automatically comprises:

- a body including a fitting area in response to a fitted tool and a receiving groove disposed therein to communicate with a front end thereof;
- a light module installed in the receiving groove and including at least one bulb and a cell set, a first electrode of the cell set connecting with a first connecting leg of the bulb, and a second electrode of the cell set connecting contacting with the fitting area of the body, and when the fitting area of the body is fitted to a fitted tool, a second connecting leg of the bulb conducting to the second electrode of the cell set.

The present invention will become more obvious from the following description when taken in connection with the accompanying drawings, which show, for purpose of illustrations only, the preferred embodiment in accordance with the present invention.

BRIEF DESCRIPTION OF THE DRAWINGS

FIG. 5 is a cross sectional view showing a bulb of the tool capable of turning on/off the light automatically according to the first embodiment of the present invention being turned on;

FIG. 9 is a cross sectional view showing a bulb of the tool capable of turning on/off the light automatically according to the second embodiment of the present invention being turned on;

FIG. 13 is a cross sectional view showing a bulb of the tool capable of turning on/off the light automatically according to the third embodiment of the present invention being turned on;

FIG. 17 is a cross sectional view showing a bulb of the tool capable of turning on/off the light automatically according to the fourth embodiment of the present invention being turned on;

FIG. 20 is a cross sectional view showing a bulb of the tool capable of turning on/off the light automatically according to the fifth embodiment of the present invention being turned on;

FIG. 22 is a cross sectional view showing a bulb of the tool capable of turning on/off the light automatically according to the sixth embodiment of the present invention being turned on.

DETAILED DESCRIPTION OF THE PREFERRED EMBODIMENT

Figure 1:
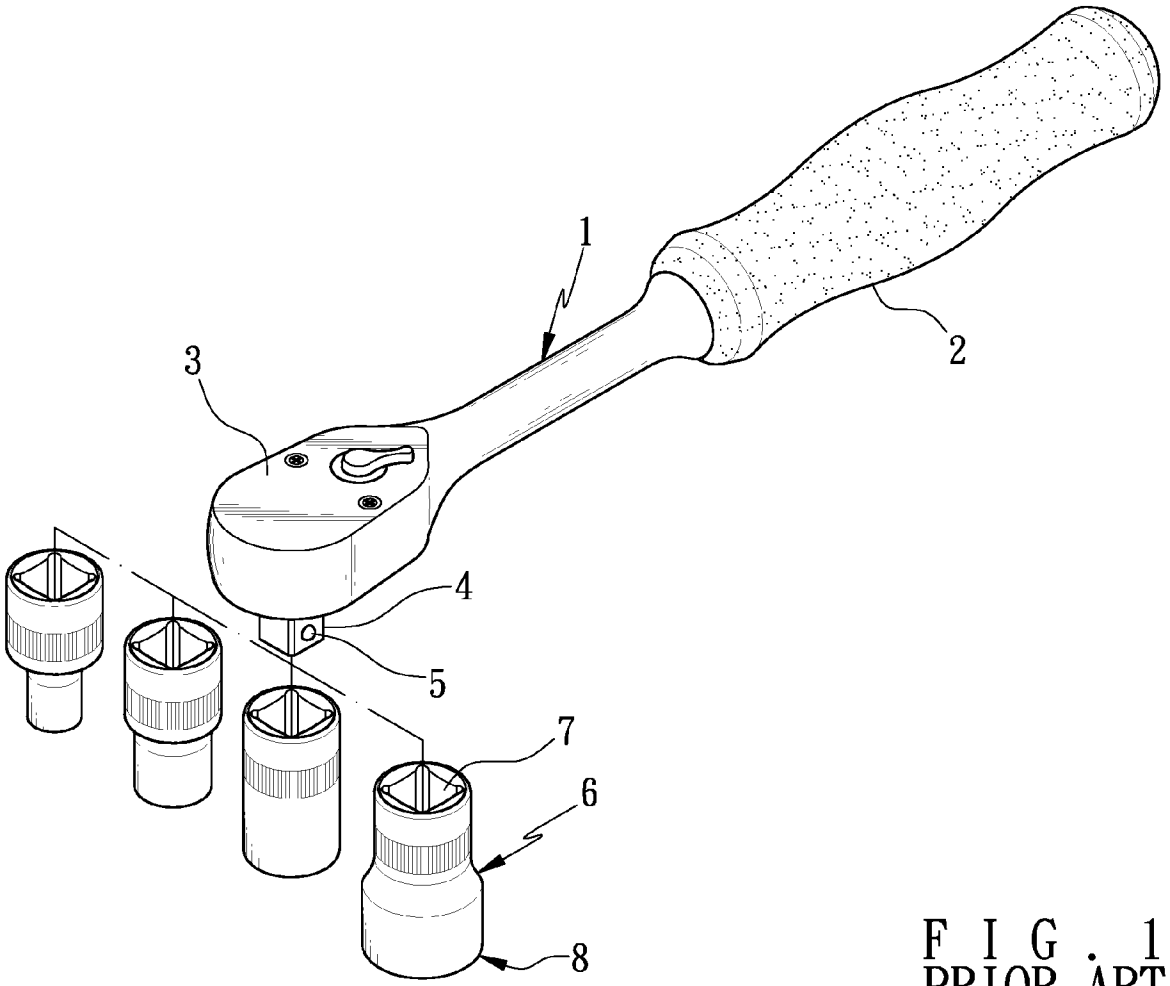
FIG. 1 PRIOR ART
FIG. 1 is a perspective view showing a conventional socket ratchet wrench and a plurality of sockets.
Figure 2:
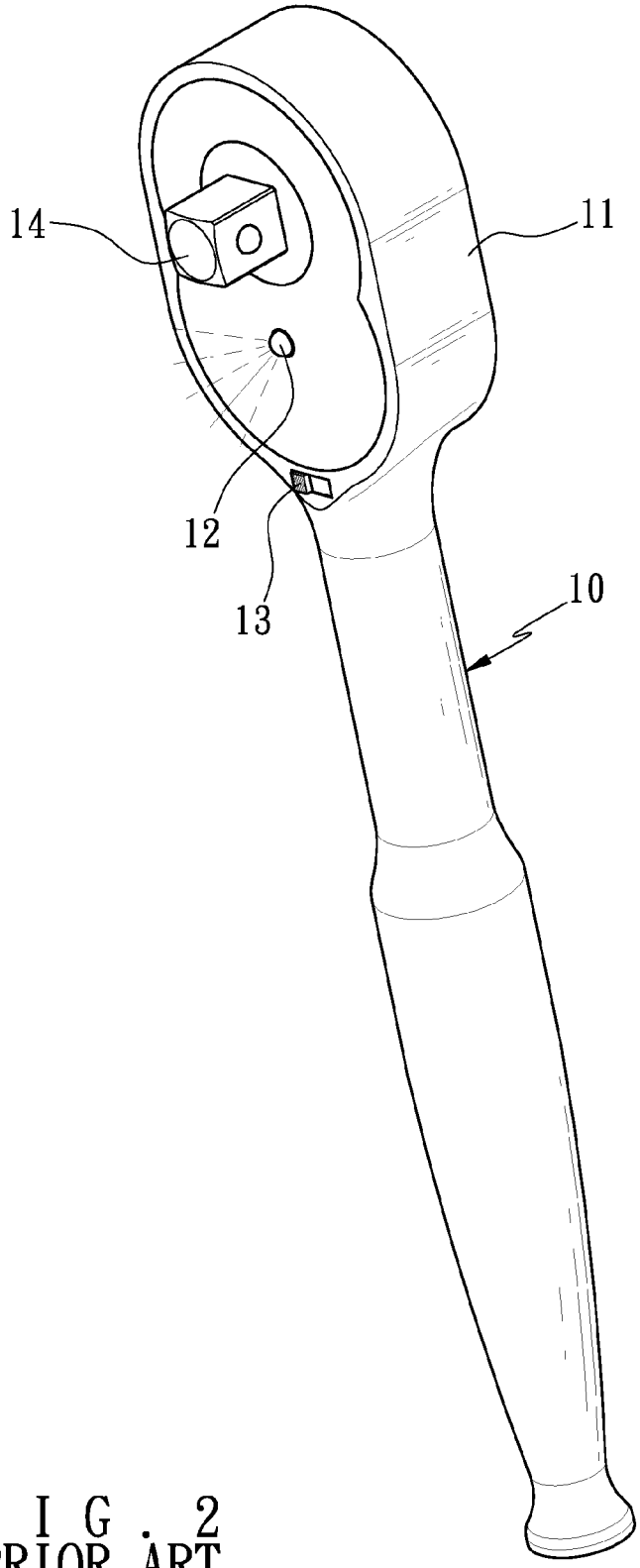
FIG. 2 PRIOR ART
FIG. 2 is a perspective view showing another conventional socket ratchet wrench.
Figure 3:
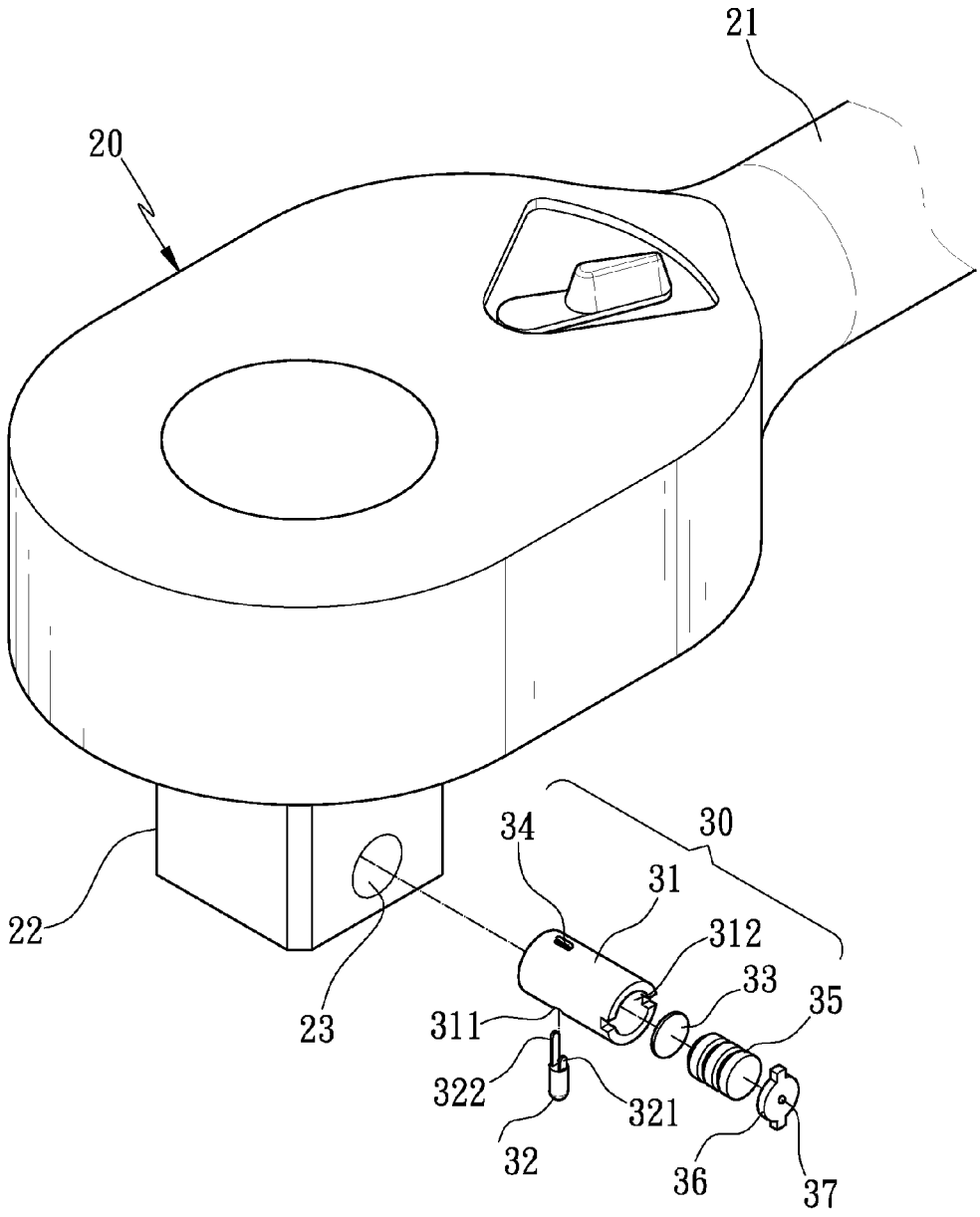
FIG. 3 is a perspective view showing the exploded components of a tool capable of turning on/off a light automatically according to a first embodiment of the present invention.
Figure 4:
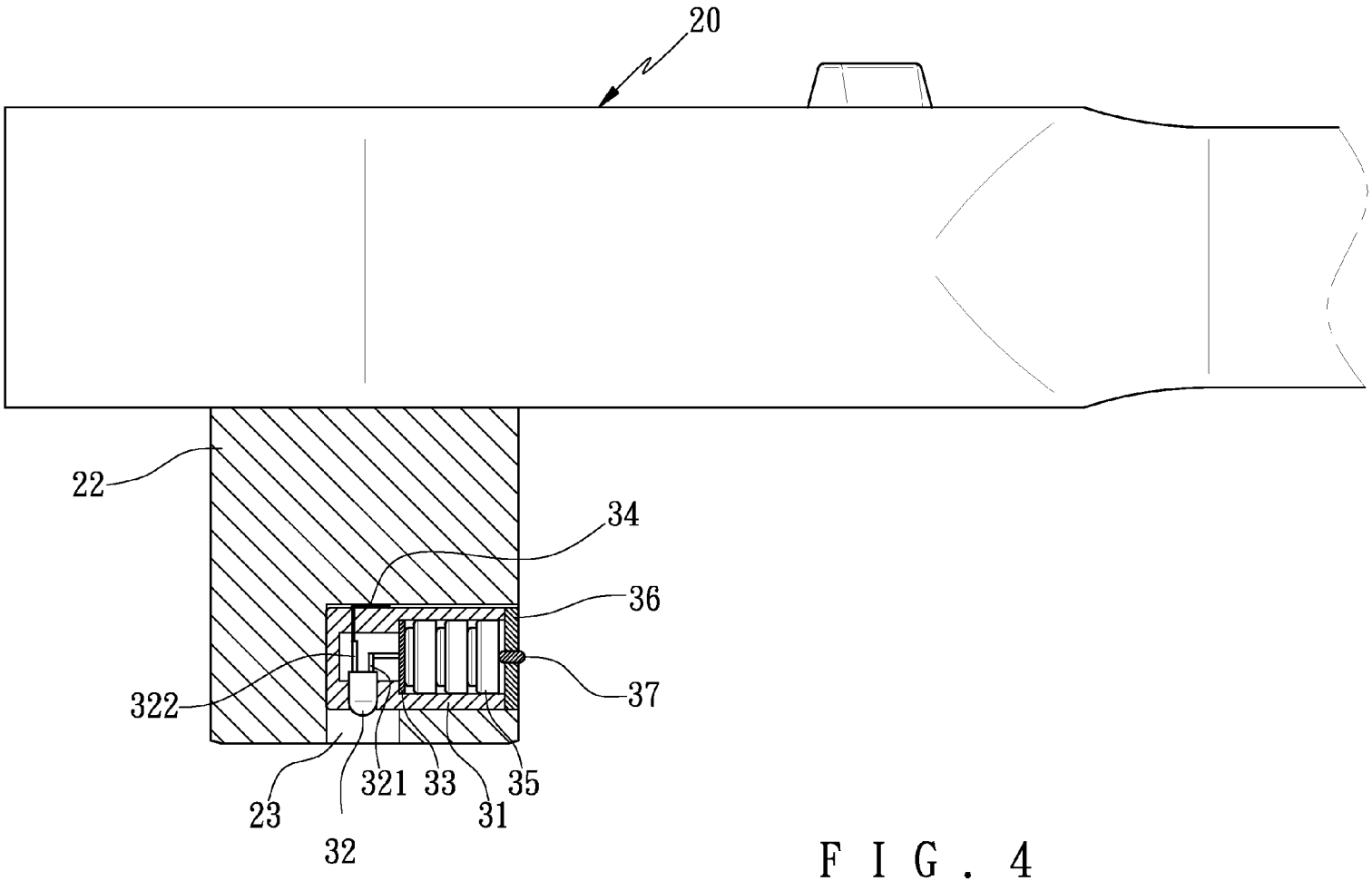
FIG. 4 is a cross sectional view showing the assembly of the tool capable of turning on/off the light automatically according to the first embodiment of the present invention.

Referring to FIGS. 3-4, a tool capable of turning on/off a light automatically in accordance with a first embodiment of the present invention is a driving tool and comprises a body 20 and a light module 30, the body 20 includes an operating area 21 and a fitting area 22 in response to a fitted tool. In this embodiment, the fitting area 22 is a tetragonal post to fit a socket; the fitting area 22 of the body 20 includes a receiving groove 23 communicating with a front end of the fitting area 22, and the receiving groove 23 includes the light module 30 installed therein, the light module 30 includes an insulating seat 31 made of plastic material, and the insulating seat 31 includes a bulb slot 311 disposed on one end thereof and a cell recess 312 mounted on another end thereof to receive at least one bulb 32, and a first connecting leg 321 of the bulb 32 connects with one side of a first conducting piece 33. In this embodiment, a second connecting leg 322 of the bulb 32 couples with a second conducting piece 34 which extends out of the insulating seat 31, and the second conducting piece 34 is a U-shaped elastic member to abut against the receiving groove 23, and the body 20 is provided to conduct the second connecting leg 322 electrically. The cell recess 312 of the insulating seat 31 is used to receive a cell set 35, and a first electrode of the cell set 35 contacts with another side of the first conducting piece 33 to be conducted to the first connecting leg 321 of the bulb 32, and the cell recess 312 includes an insulated cover member 36 fixed on a rear end thereof, the cover member 36 includes a third conducting piece 37 secured thereon so that one end of the third conducting piece 37 contacts with a second electrode of the cell set 35, and another end thereof abuts against the fitting area 22 of the body 20. In assembly, the light module 30 is assembled to the receiving groove 23 of the body 20 directly, and the second conducting piece 34 is contacted with the body 20, another end of the third conducting piece 37 is biased against the fitting area 22 of the body 20.

Figure 5:
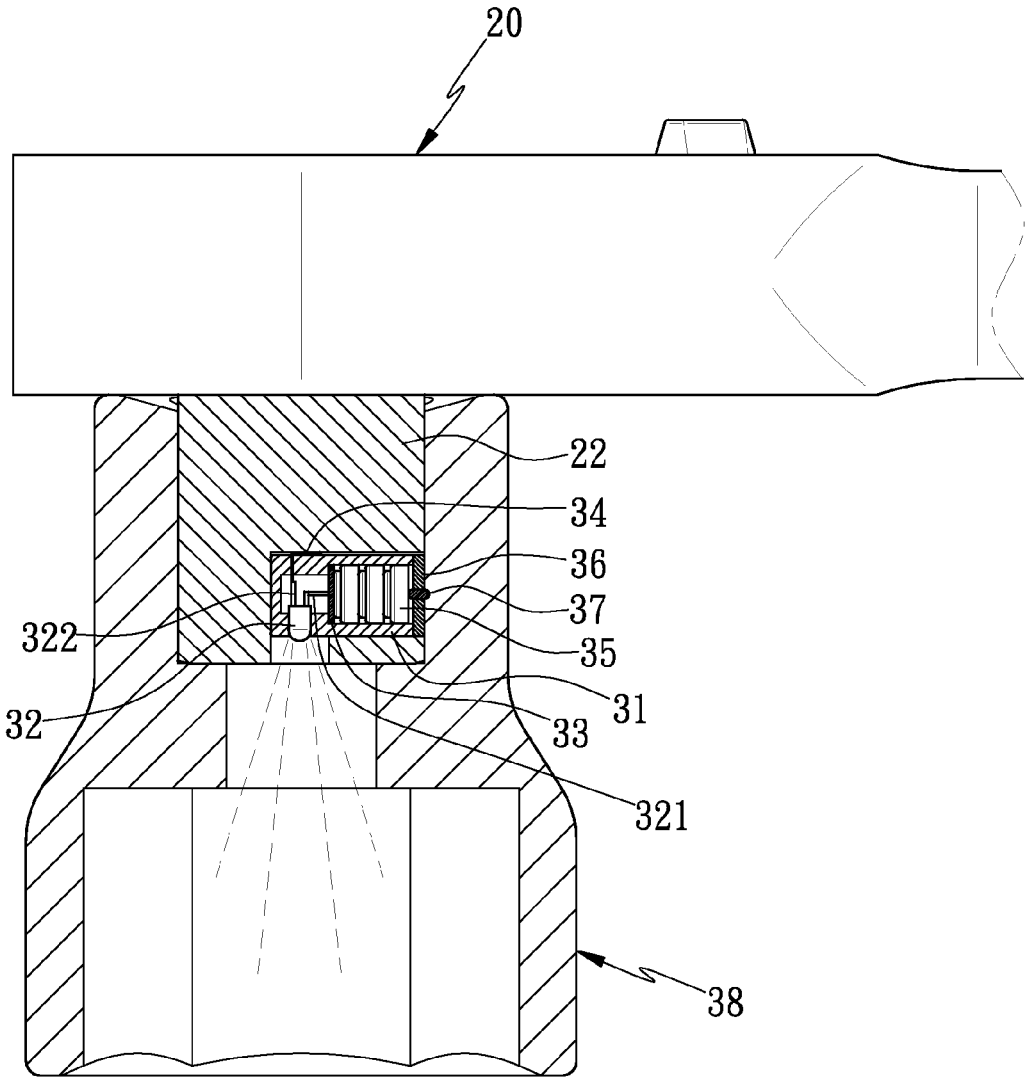

As shown in FIG. 5, when the fitting area 22 of the body 20 is fitted to a socket 38, the socket 38 contacts with the third conducting piece 37 so that the second electrode of the cell set 35 conducts to the second connecting leg 322 of the bulb 32 via the socket 38, the body 20, and the second conducting piece 34 to generate a conducted circuit, thus turning on the bulb 32 automatically. In contrast, when the socket 38 disengages from the fitting area 22 of the body 20, the second electrode of the cell set 35 and the second connecting leg 322 of the bulb 32 generate a break to turn on the bulb 32 automatically, thereby turning on/off the bulb easily.

Figure 6:
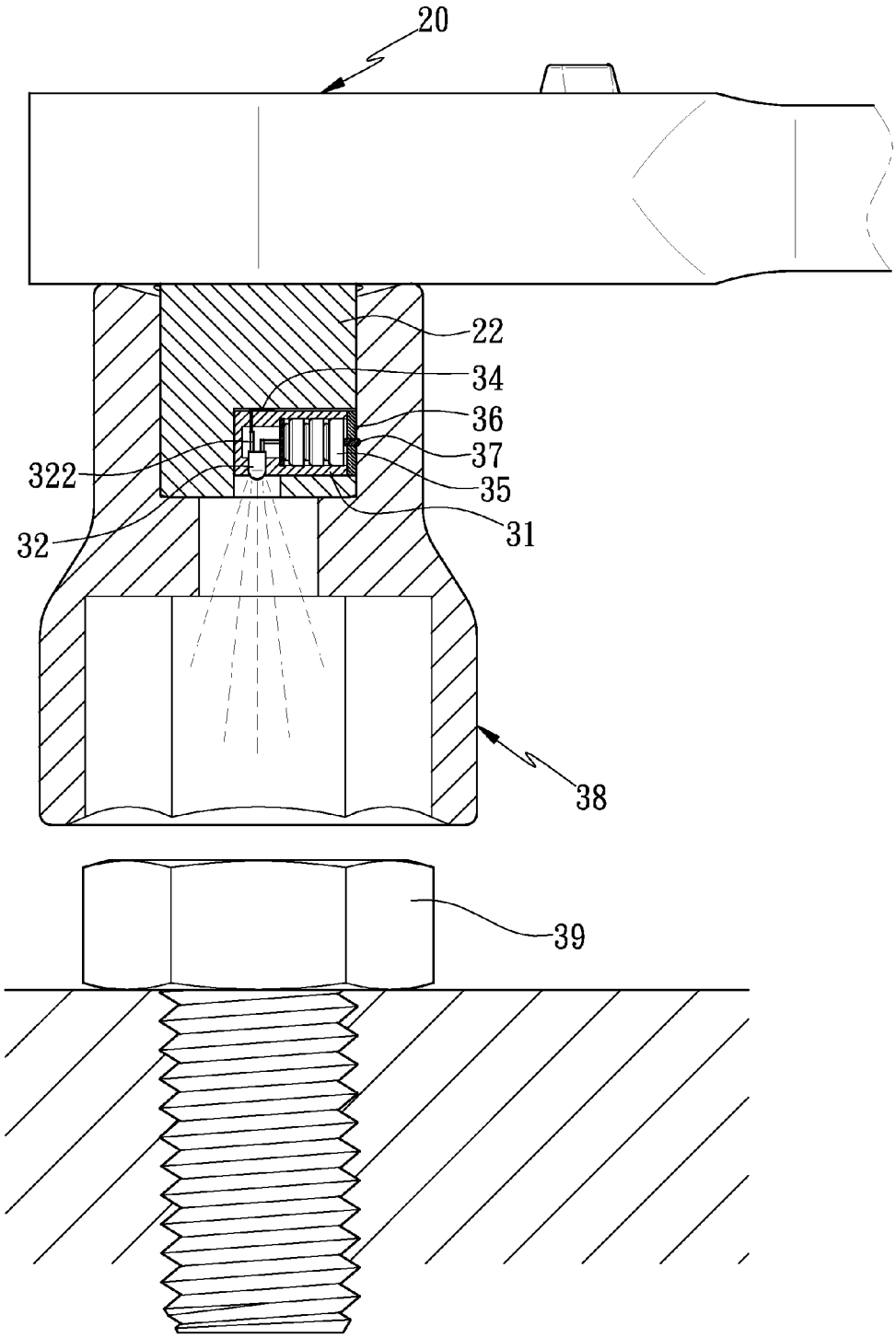
FIG. 6 is a cross sectional view showing the operation of the tool capable of turning on/off the light automatically according to the first embodiment of the present invention.

Referring to FIG. 6, the fitting area 22 of the body 20 is fitted to the socket 38, and after the bulb 32 is turned on, the light illuminates to a desired position of a locking member 39 via the socket 38 without being stopped by an obstacle, thereby assembling and disassembling the locking member conveniently.

Figure 7:
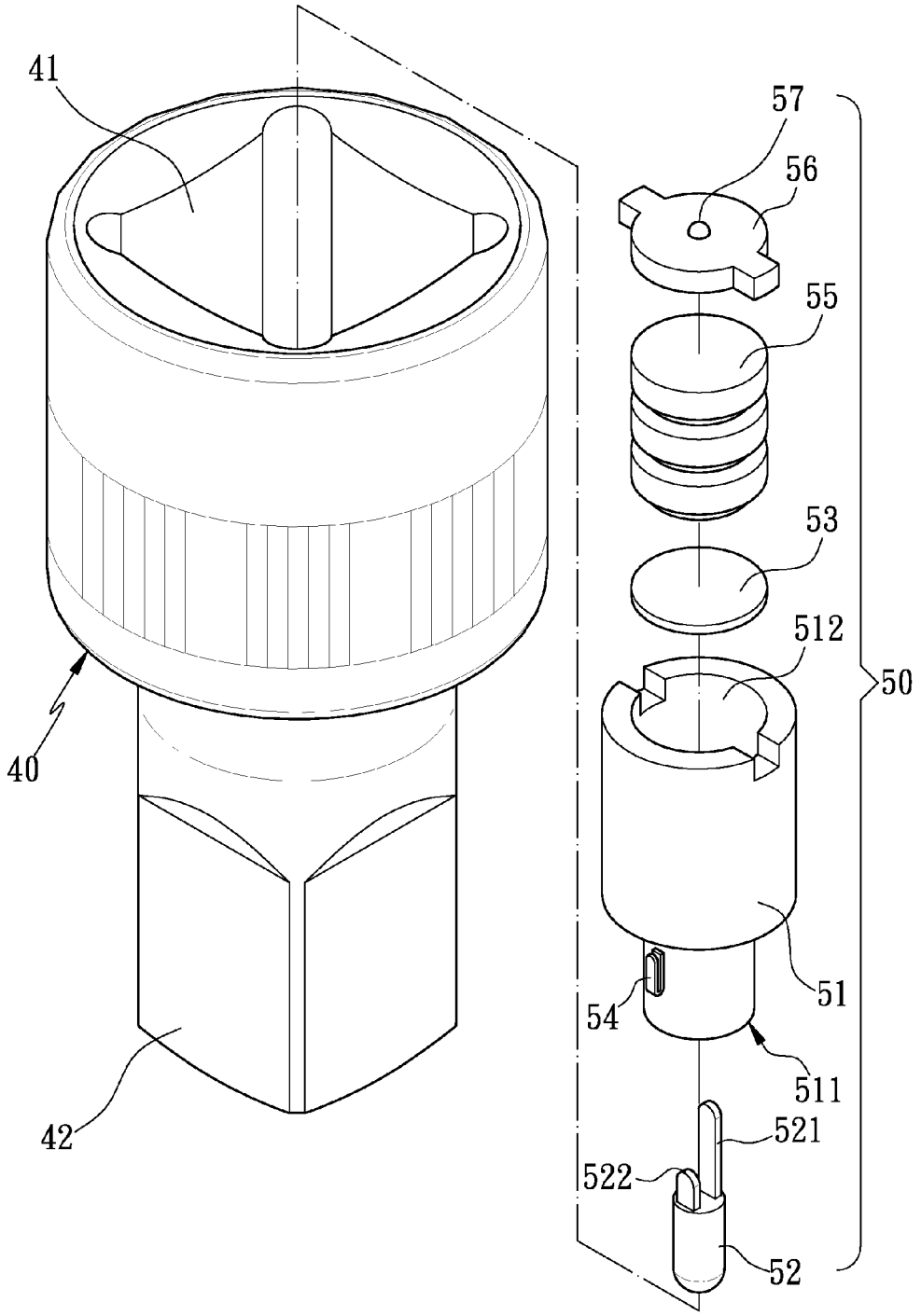
FIG. 7 is a perspective view showing the exploded components of a tool capable of turning on/off a light automatically according to a second embodiment of the present invention.
Figure 8:
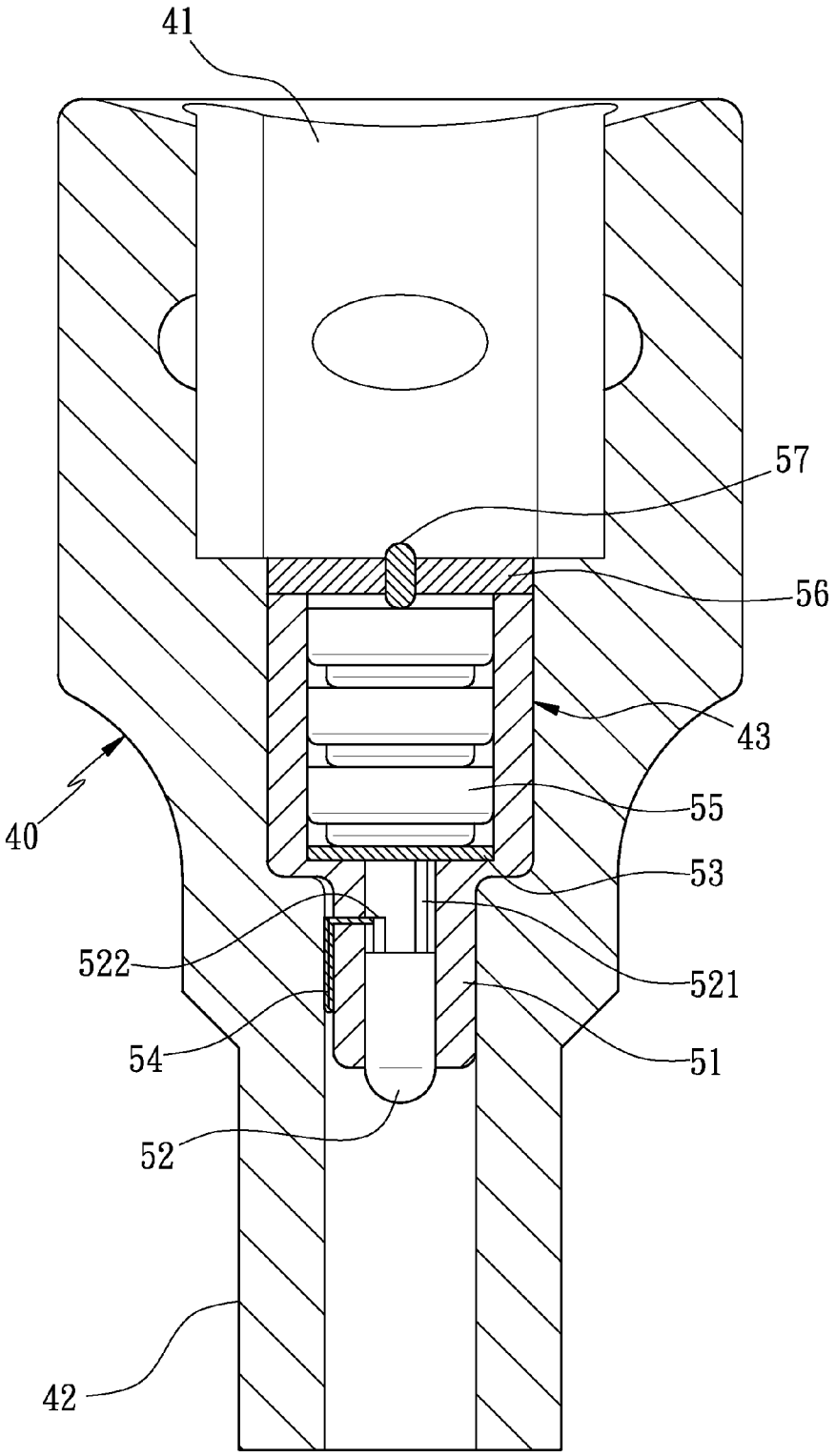
FIG. 8 is a cross sectional view showing the assembly of the tool capable of turning on/off the light automatically according to the second embodiment of the present invention.

As illustrated in FIGS. 7 and 8, a tool capable of turning on/off a light automatically in accordance with a second embodiment of the present invention is a coupling tool and comprises a body 40 and a light module 50, the body 40 includes a fitting area 41 disposed on one end thereof in response to a fitted tool, the fitting area 41 is formed in a polygonal post or hole shape based on a driven tool (such as a power tool, pneumatic tool, open end wrench, socket wrench, screwdriver handle, etc.). In this embodiment, the fitting area 41 is formed in a tetragonal hole shaped to fit a socket wrench, and another end of the body 40 is fitted to a working area 42 of an operating tool or a locking member, the working area 42 is formed in a polygonal post, cross post, box post or polygonal hole shape. In this embodiment, the working area 42 is formed in a tetragonal post shape, and the body 40 includes a receiving groove 43 disposed therein to communicate with a front end thereof, and a light module 50 is installed in the receiving groove 43 and includes an insulating seat 51 made of plastic material, the insulating seat 51 includes a bulb slot 511 mounted on one end thereof and a cell recess 512 fixed on another end thereof to receive at least one bulb 52, and a first connecting leg 521 of the bulb 52 couples to one side of a first conducting piece 53 of the cell recess 512. In this embodiment, a second connecting leg 522 of the bulb 52 connects with a second conducting piece 54 which extends out of the insulating seat 51, and the second conducting piece 54 is a U-shaped elastic member to abut against the receiving groove 43, the body 20 is provided to conduct the circuit. The cell recess 512 of the insulating seat 51 is used to receive a cell set 55, and a first electrode of the cell set 55 contacts with another side of the first conducting piece 53 to be conducted to a first connecting leg 521 of the bulb 52, and the cell recess 512 includes an insulated cover member 56 arranged on a rear end thereof, the cover member 56 includes a third conducting piece 57 disposed thereon, one end of the third conducting piece 57 contacts with a second electrode of the cell set 55, and another end thereof abuts against the fitting area 41 of the body 40. In assembly, the light module 50 is assembled to the receiving groove 43 of the body 40 so that the second conducting piece 54 contacts with the body 40, and another end of the third conducting piece 57 is adjacent to the fitting area 41 of the body 40.

Figure 9:
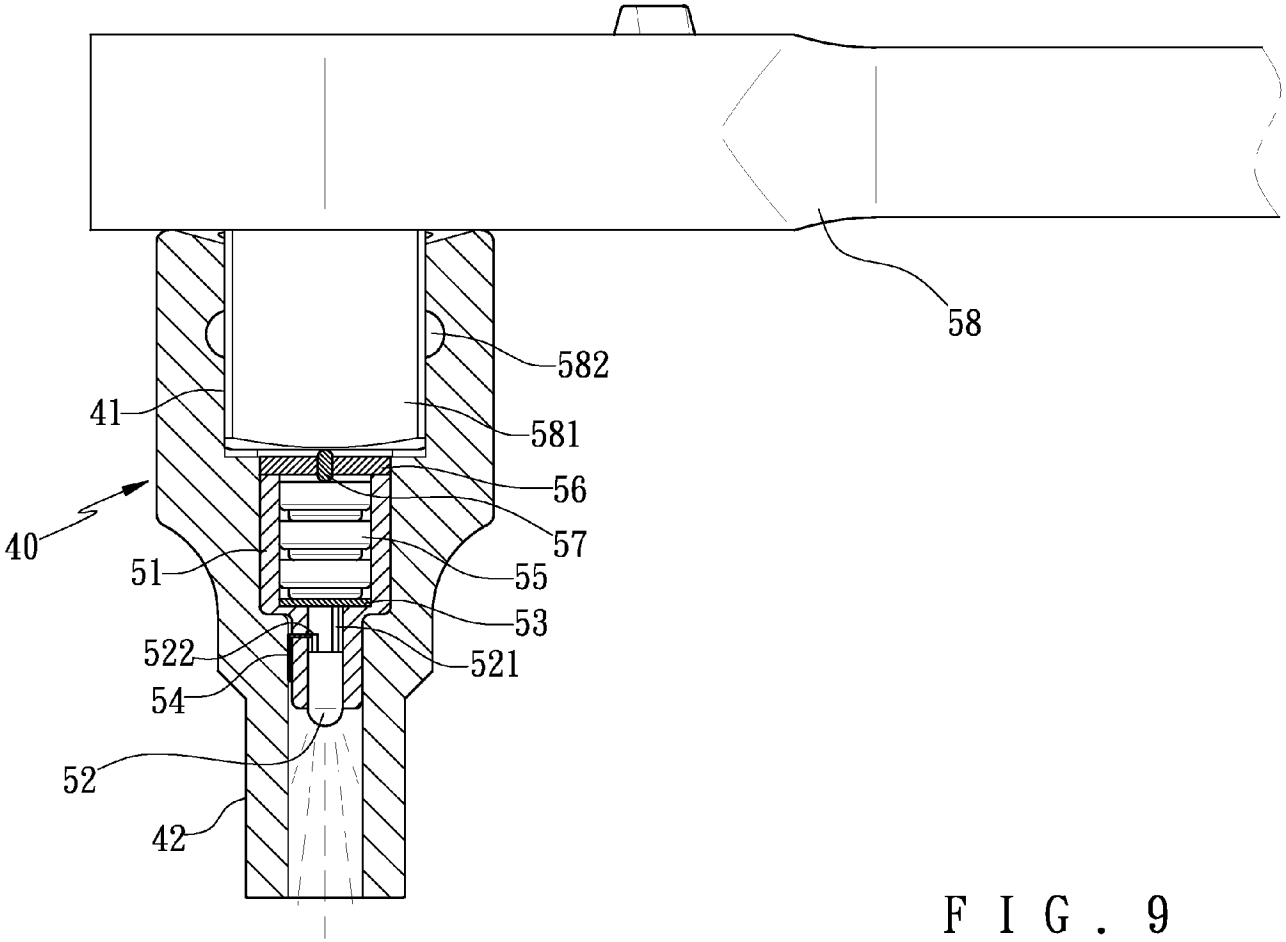

With reference to FIG. 9, when a socket ratchet wrench 58 is fitted to the fitting area 41 of the body 40, a post 581 of the socket ratchet wrench 58 is inserted to the fitting area 41 so that a retaining ball 582 is engaged with an inner wall of the fitting area 41, wherein the post 581 abuts against a third conducting piece 57 so that a second electrode of the cell set 55 is conducted to the second connecting leg 522 of the bulb 52 through the post 581, the body 40, and the second conducting piece 54 to generate a conducted circuit to turn on the bulb 52 automatically. Furthermore, when the socket ratchet wrench 58 disengages from the fitting area 41 of the body 40, a break between the second electrode of the cell set 55 and the second connecting leg 522 of the bulb 52 generates to turn off the bulb 52 automatically.

Figure 10:
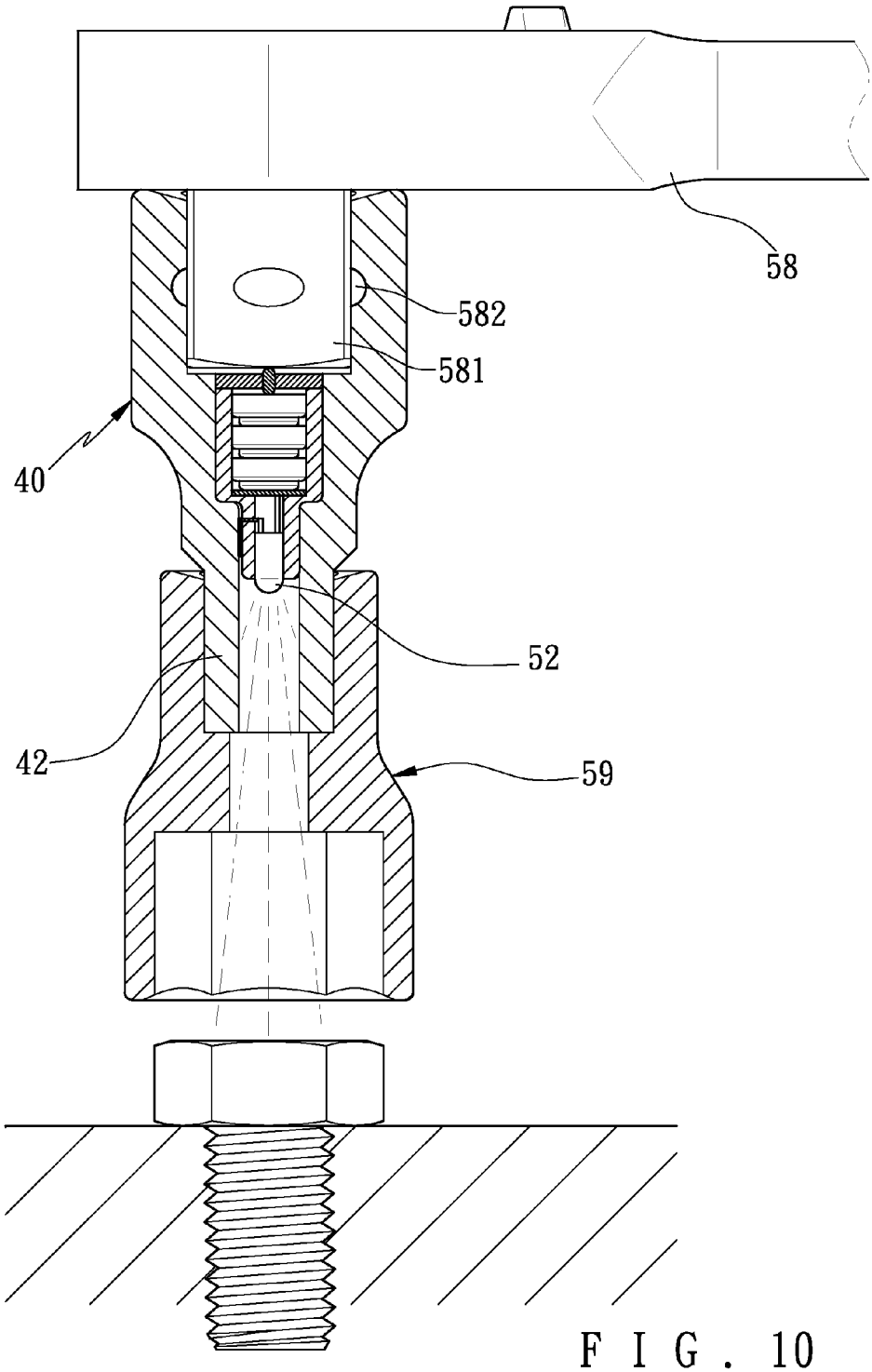
FIG. 10 is a cross sectional view showing the operation of the tool capable of turning on/off the light automatically according to the second embodiment of the present invention.

As illustrated in FIG. 10, the working area 42 of the body 40 allows to receive various sizes of sockets 59, and after the bulb 52 is turned on, the light illuminates a locking member closely without being stopped by an obstacle, thereby assembling and disassembling the locking member conveniently.

Figure 11:
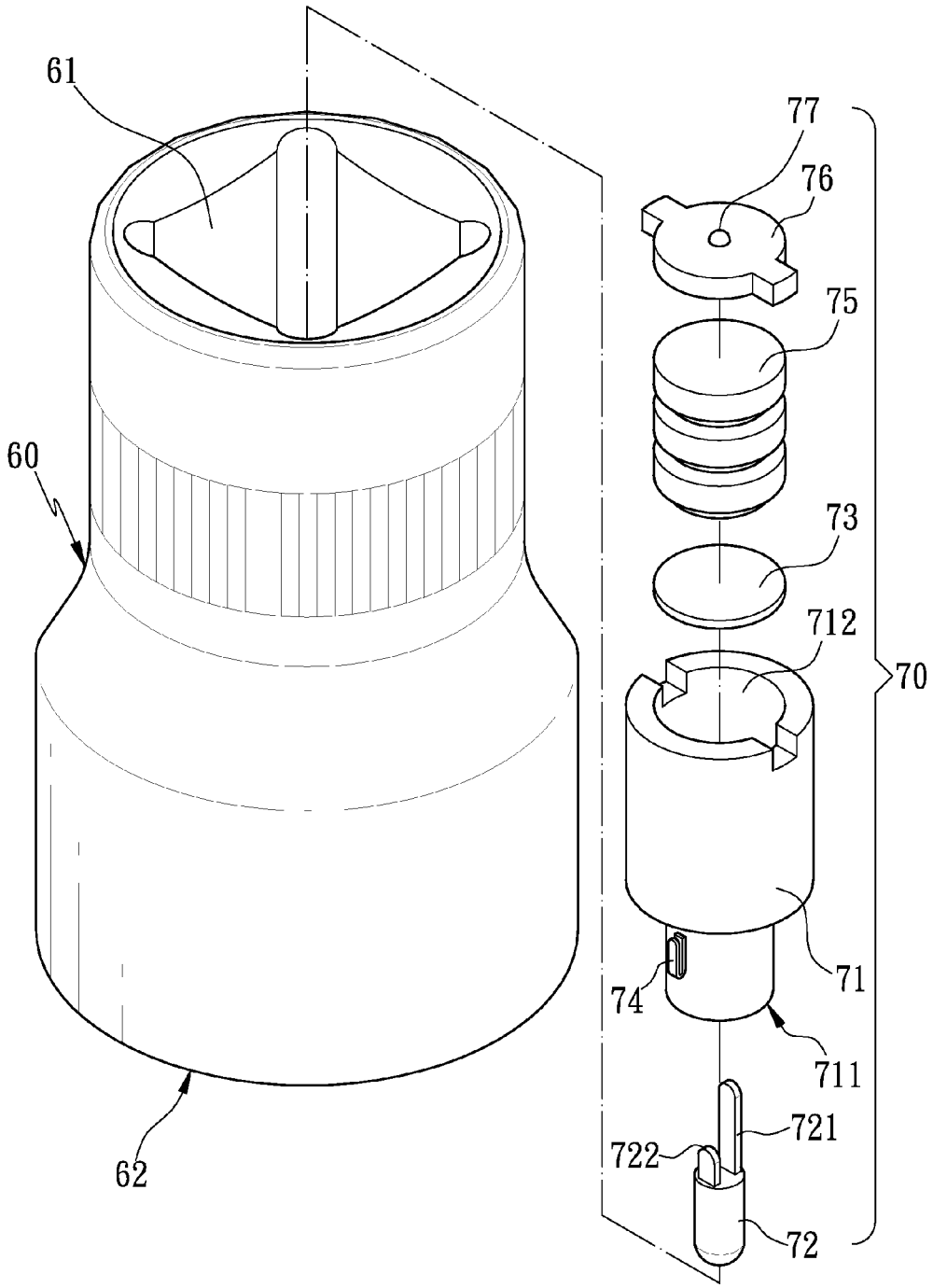
FIG. 11 is a perspective view showing the exploded components of a tool capable of turning on/off a light automatically according to a third embodiment of the present invention.
Figure 12:
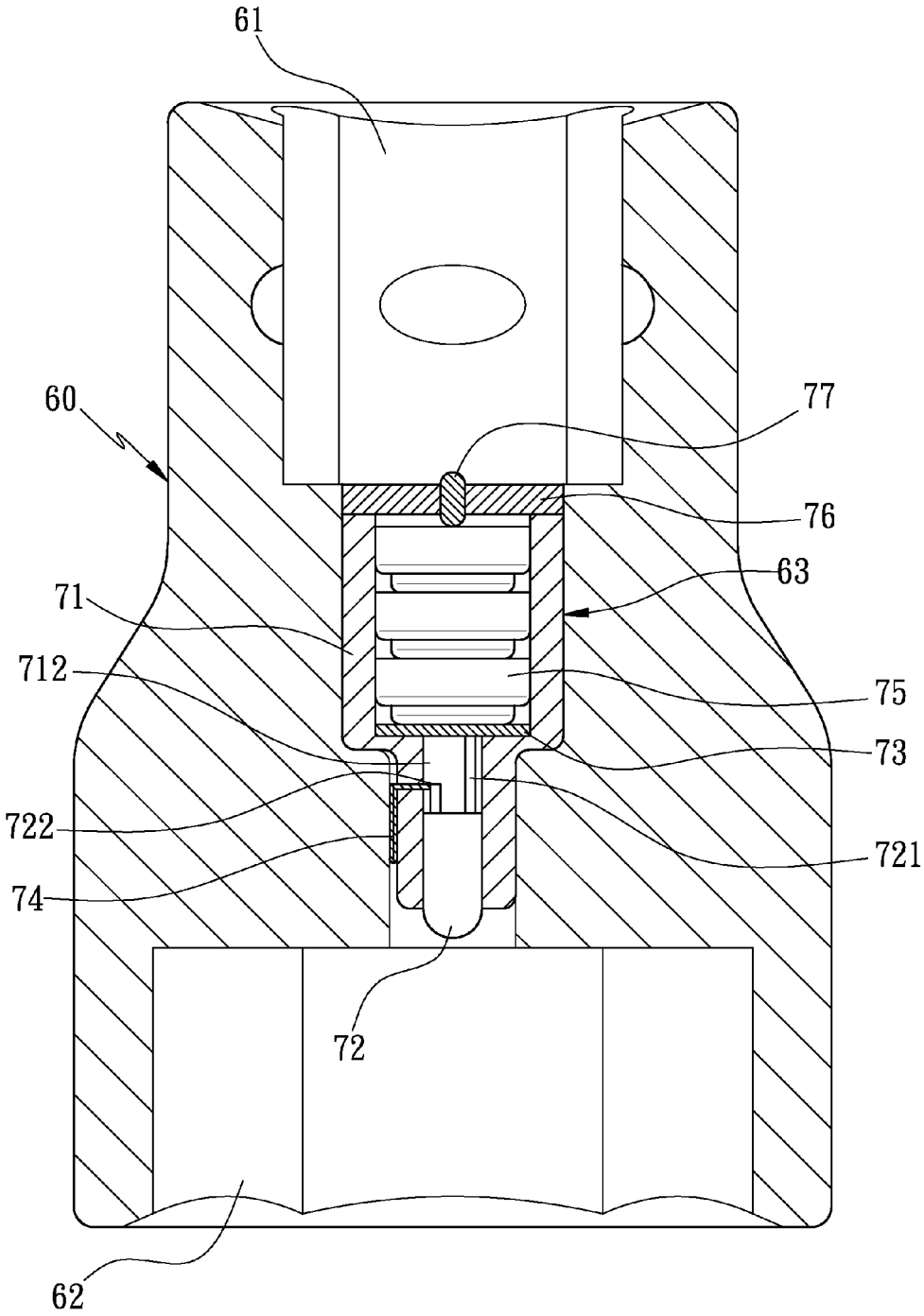
FIG. 12 is a cross sectional view showing the assembly of the tool capable of turning on/off the light automatically according to the third embodiment of the present invention.

Referring to FIGS. 11 and 12, a tool capable of turning on/off a light automatically in accordance with a third embodiment of the present invention is a socket tool and comprises a body 60 and a light module 70, the body 60 includes a fitting area 61 disposed on one end thereof in response to a fitted tool, and the fitting area 61 is a tetragonal bore to receive a socket ratchet wrench, the body 60 also includes a working area 62 mounted on another end to receive a locking member, the working area 62 is formed in a polygonal post, cross post, box post or polygonal hole shape. In this embodiment, the working area 62 is formed in a hexagonal bore shape to receive a screw bolt, and the body 60 includes a receiving groove 63 disposed therein to communicate with a front end thereof, and a light module 70 is installed in the receiving groove 63 and includes an insulating seat 71 made of plastic material, the insulating seat 71 includes a bulb slot 711 mounted on one end thereof and a cell recess 712 fixed on another end thereof to receive at least one bulb 72, a first connecting leg 721 of the bulb 72 couples to one side of a first conducting piece 73 of the cell recess 712. In this embodiment, a second connecting leg 722 of the bulb 72 connects with a second conducting piece 74 which extends out of the insulating seat 71, and the second conducting piece 74 is a U-shaped elastic member to abut against the receiving groove 63, the body 60 is provided to conduct the circuit. The cell recess 712 of the insulating seat 71 is used to receive a cell set 75, and a first electrode of the cell set 75 contacts with another side of the first conducting piece 73 to be conducted to the first connecting leg 721 of the bulb 72, and the cell recess 712 includes an insulated cover member 76 arranged on a rear end thereof, the cover member 76 includes a third conducting piece 77 disposed thereon, one end of the third conducting piece 77 contacts with a second electrode of the cell set 75, and another end thereof abuts against the fitting area 61 of the body 60. In assembly, the light module 70 is assembled to the receiving groove 63 of the body 60 so that the second conducting piece 74 contacts with the body 60, and another end of the third conducting piece 77 is adjacent to the fitting area 61 of the body 60.

Figure 13:
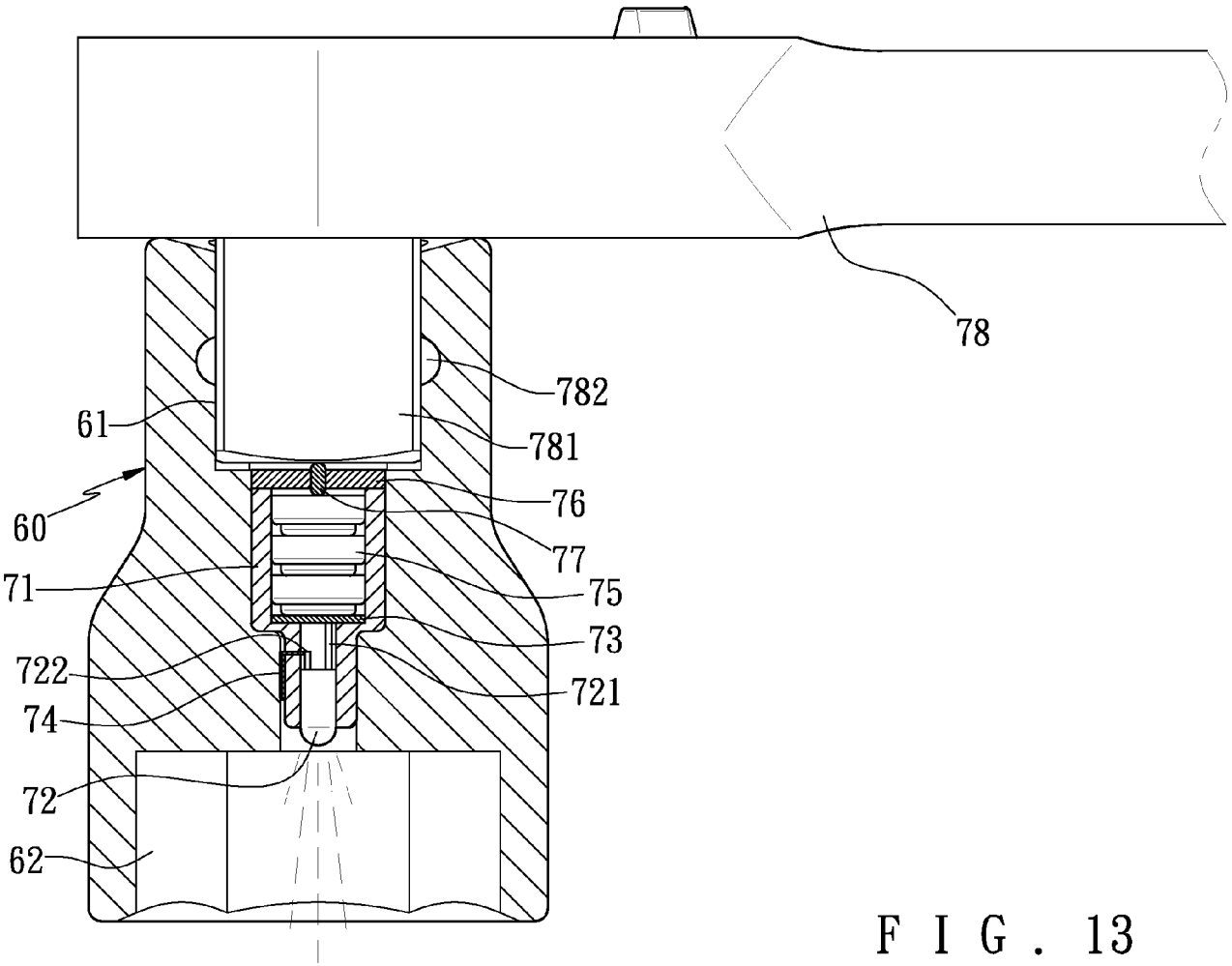

As shown in FIG. 13, when the fitting area 62 of the body 60 is fitted to a socket ratchet wrench 78, a post 781 of the socket ratchet wrench 78 is inserted to the fitting area 61 so that a retaining ball 782 of the post 781 is engaged with an inner wall of the fitting area 61, wherein the post 781 abuts against a third conducting piece 77 so that a second electrode of the cell set 75 is conducted to the second connecting leg 722 of the bulb 72 through the post 781, the body 60, and the second conducting piece 74 to generate a conducted circuit to turn on the bulb 72 automatically. Furthermore, when the socket ratchet wrench 78 disengages from the fitting area 61 of the body 60, a break between the second electrode of the cell set 75 and the second connecting leg 722 of the bulb 72 generates to turn off the bulb 72 automatically.

Figure 14:
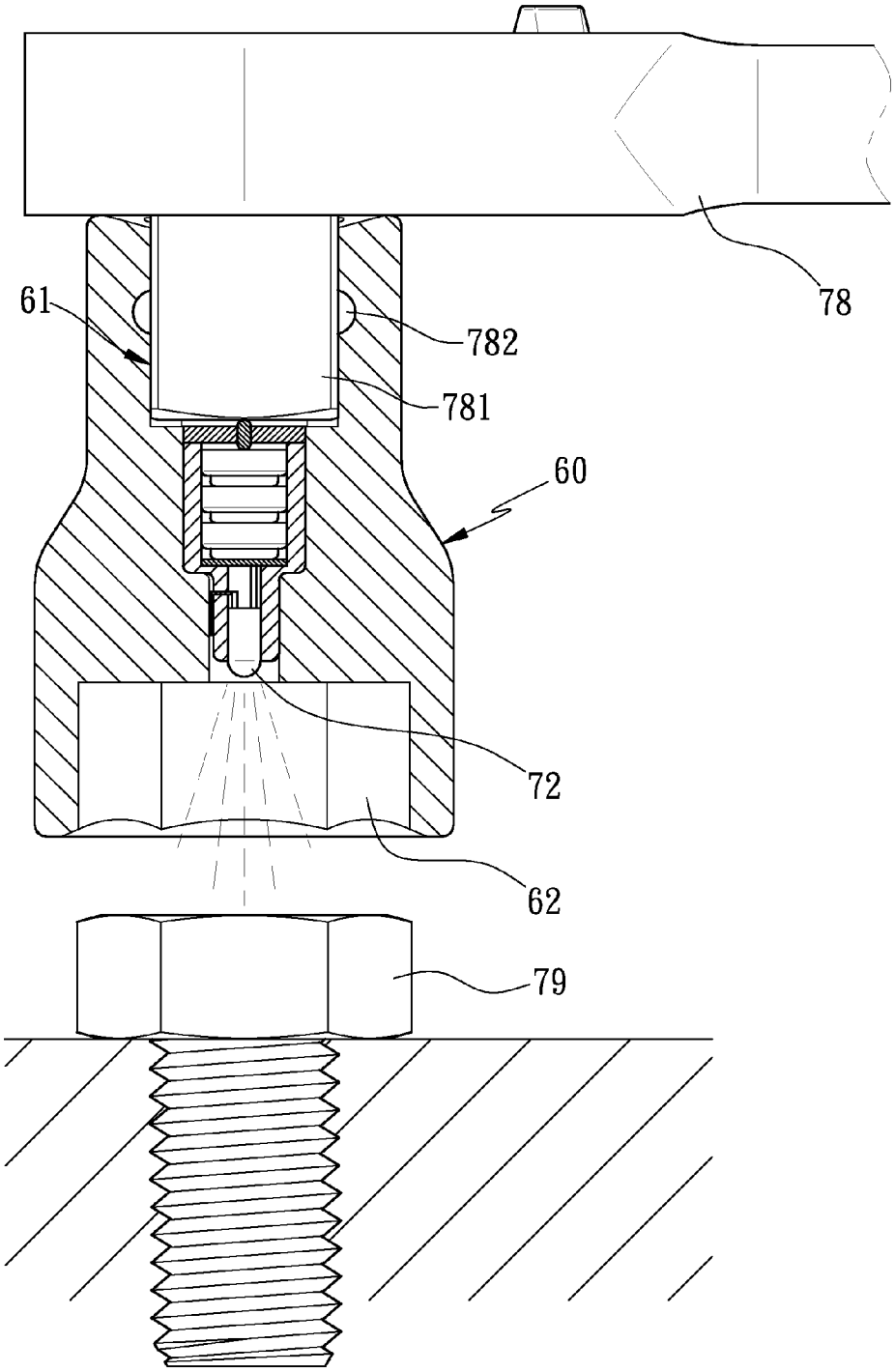
FIG. 14 is a cross sectional view showing the operation of the tool capable of turning on/off the light automatically according to the third embodiment of the present invention.

As illustrated in FIG. 14, after the bulb 72 is turned on, the light illuminates a desired assembled or disassembled locking member closely without being stopped by an obstacle so that the working area 62 is fitted to a locking member 79 clearly, thereby assembling and disassembling the locking member conveniently.

Referring to FIGS. 11 and 12, a tool capable of turning on/off a light automatically in accordance with a third embodiment of the present invention is a socket tool and comprises a body 60 and a light module 70, the body 60 includes a fitting area 61 disposed on one end thereof in response to a fitted tool, and the fitting area 61 is a tetragonal bore to receive a socket ratchet wrench, the body 60 also includes a working area 62 mounted on another end to receive a locking member, the working area 62 is formed in a polygonal post, cross post, box post or polygonal hole shape. In this embodiment, the working area 62 is formed in a hexagonal bore shape to receive a screw bolt, and the body 60 includes a receiving groove 63 disposed therein to communicate with a front end thereof; and a light module 70 is installed in the receiving groove 63, and includes an insulating seat 71 made of plastic material, the insulating seat 71 includes a bulb slot 711 mounted on one end thereof and a cell recess 712 fixed on another end thereof to receive at least one bulb 72, and a first connecting leg 721 of the bulb 72 couples to one side of a first conducting piece 73 of a cell recess 712. In this embodiment, a second connecting leg 722 of the bulb 72 connects with a second conducting piece 74 which extends out of the insulating seat 71, and the second conducting piece 74 is a U-shaped elastic member to abut against the receiving groove 63, and the body 60 is provided to conduce the circuit. The cell recess 712 of the insulating seat 71 is used to receive a cell set 75, and a first electrode of the cell set 75 contacts with another side of the first conducting piece 73 to be conducted to a first connecting leg 721 of the bulb 72, and the cell recess 712 includes an insulated cover member 76 arranged on a rear end thereof, and the cover member 76 includes a third conducting piece 77 disposed thereon, one end of the third conducting piece 77 contacts with a second electrode of the cell set 75, and another end thereof abuts against the fitting area 61 of the body 60. In assembly, the light module 70 is assembled to the receiving groove 63 of the body 60 so that the second conducting piece 74 contacts with the body 60, and another end of the third conducting piece 77 is adjacent to the fitting area 61 of the body 60.

Figure 15:
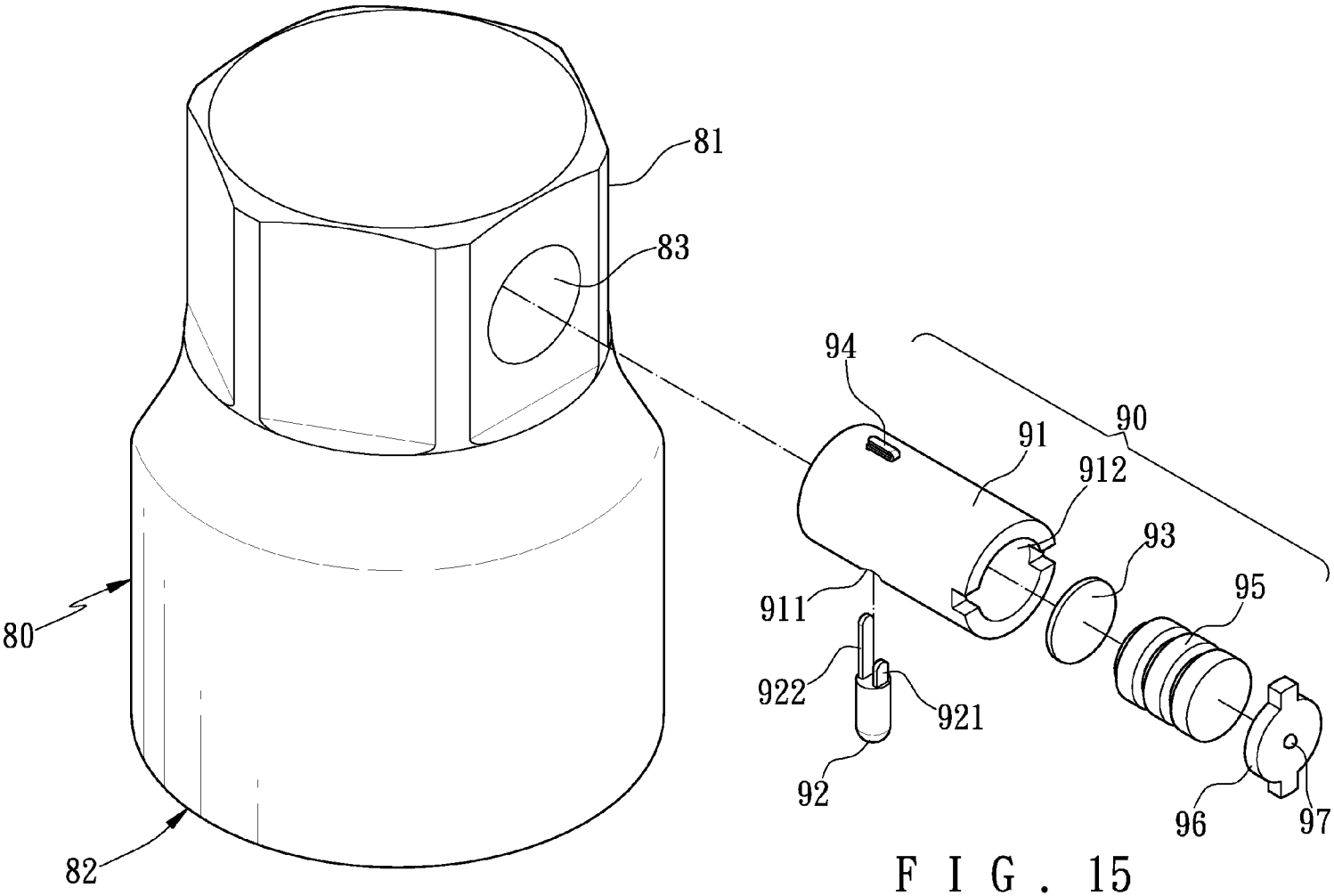
FIG. 15 is a perspective view showing the exploded components of a tool capable of turning on/off a light automatically according to a fourth embodiment of the present invention.
Figure 16:
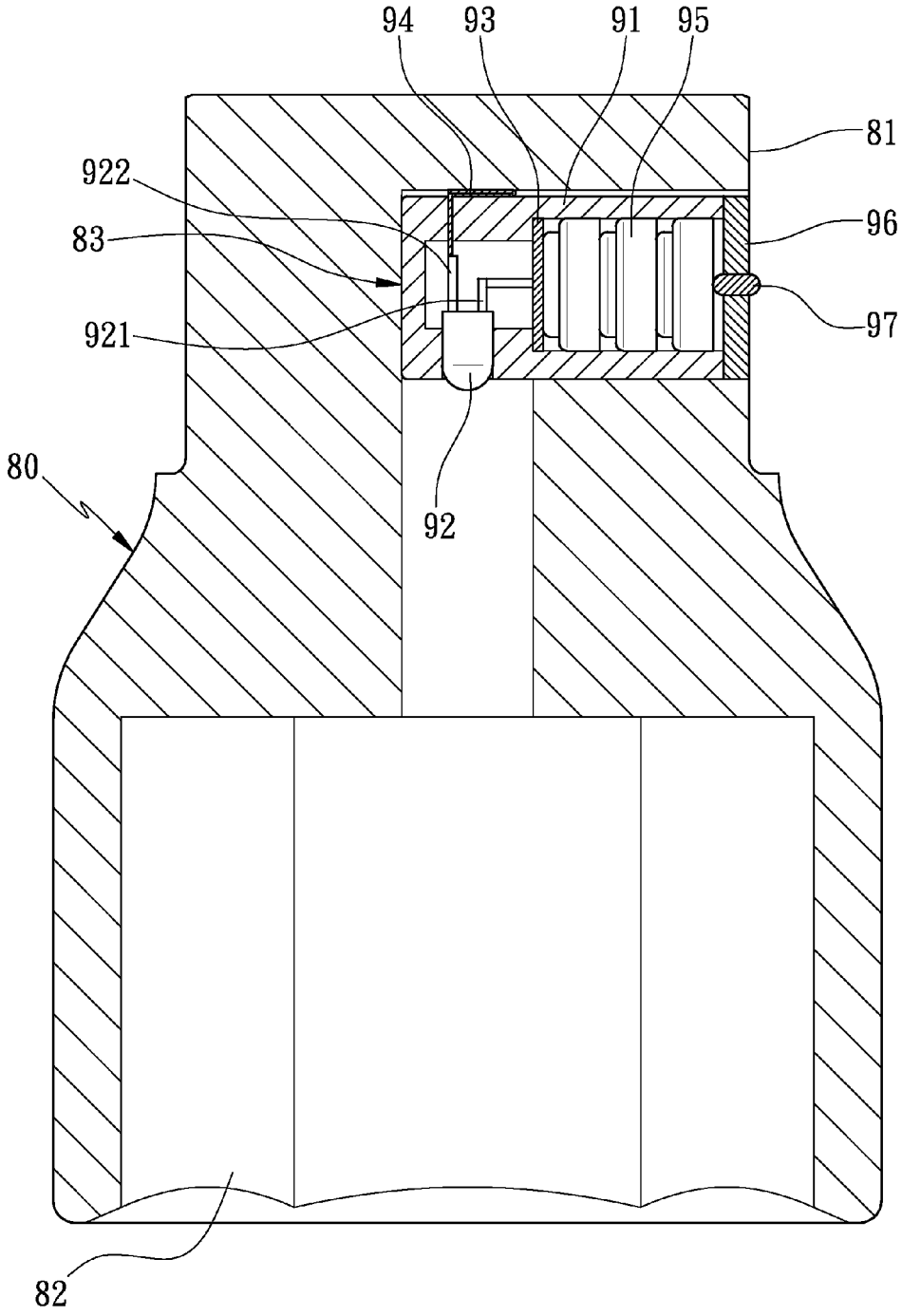
FIG. 16 is a cross sectional view showing the assembly of the tool capable of turning on/off the light automatically according to the fourth embodiment of the present invention.

Referring to FIGS. 15 and 16, a tool capable of turning on/off a light automatically in accordance with a fourth embodiment of the present invention is a socket tool and comprises a body 80 and a light module 90, the body 80 includes a fitting area 81 disposed on one end thereof in response to a fitted tool, and the fitting area 81 is a hexagonal post to receive a ratchet wrench, the body 80 also includes a working area 82 mounted on another end to receive a locking member, the working area 82 is formed in a polygonal post, cross post, box post or polygonal hole shape. In this embodiment, the working area 82 is formed in a hexagonal bore shape to receive a screw bolt, and the body 80 includes a receiving groove 83 disposed therein to communicate with a front end thereof, and a light module 90 is installed in the receiving groove 83 and includes an insulating seat 91 made of plastic material, the insulating seat 91 includes a bulb slot 911 mounted on one end thereof and a cell recess 912 fixed on another end thereof to receive at least one bulb 92, and a first connecting leg 921 of the bulb 92 couples to one side of a first conducting piece 93 of a cell recess 912. In this embodiment, a second connecting leg 922 of the bulb 92 connects with a second conducting piece 94 which extends out of the insulating seat 91, and the second conducting piece 94 is a U-shaped elastic member to abut against the receiving groove 83, the body 80 is provided to conduct the circuit. The cell recess 912 of the insulating seat 91 is used to receive a cell set 95, and a first electrode of the cell set 95 contacts with another side of the first conducting piece 93 to be conducted to a first connecting leg 921 of the bulb 92, the cell recess 912 includes an insulated cover member 96 arranged on a rear end thereof, and the cover member 96 includes a third conducting piece 97 disposed thereon, one end of the third conducting piece 97 contacts with a second electrode of the cell set 95, and another end thereof abuts against the fitting area 81 of the body 80. In assembly, the light module 90 is assembled to the receiving groove 83 of the body 80 so that the second conducting piece 94 contacts with the body 80, and another end of the third conducting piece 97 is adjacent to the fitting area 81 of the body 80.

Figure 17:
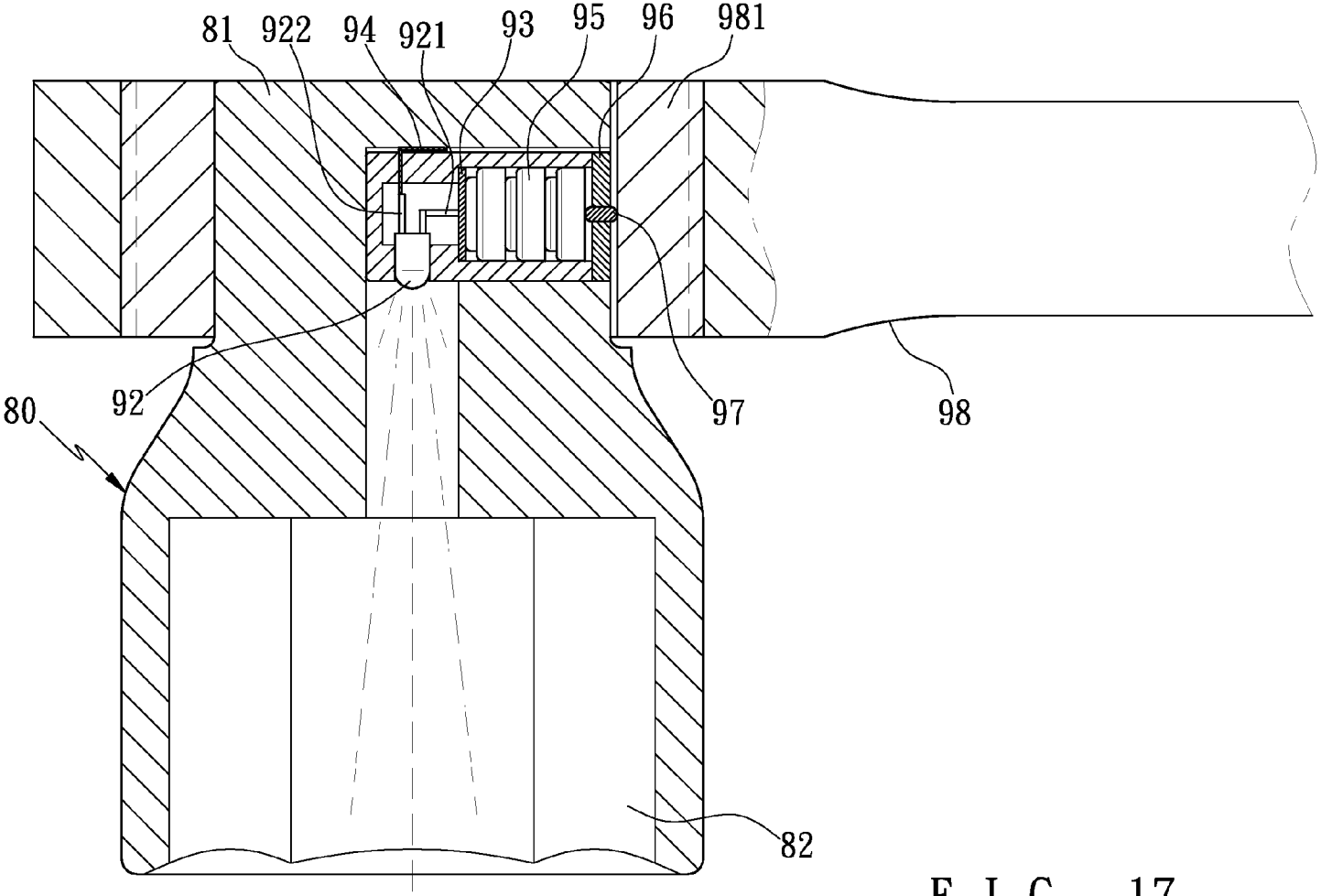

As shown in FIG. 17, when the fitting area 81 of the body 80 is fitted to a ratchet wrench 98, a loop member 981 of the ratchet wrench 98 is fitted to an exterior of the fitting area 81, wherein the loop member 981 abuts against a third conducting piece 97 so that the second electrode of the cell set 95 is conducted to the second connecting leg 922 of the bulb 92 through the loop member 981, the body 80, and the second conducting piece 94 to generate a conducted circuit to turn on the bulb 92 automatically. Furthermore, when the ratchet wrench 98 disengages from the fitting area 81 of the body 80, a break between the second electrode of the cell set 95 and the second connecting leg 922 of the bulb 92 generates to turn off the bulb 92 automatically.

Figure 18:
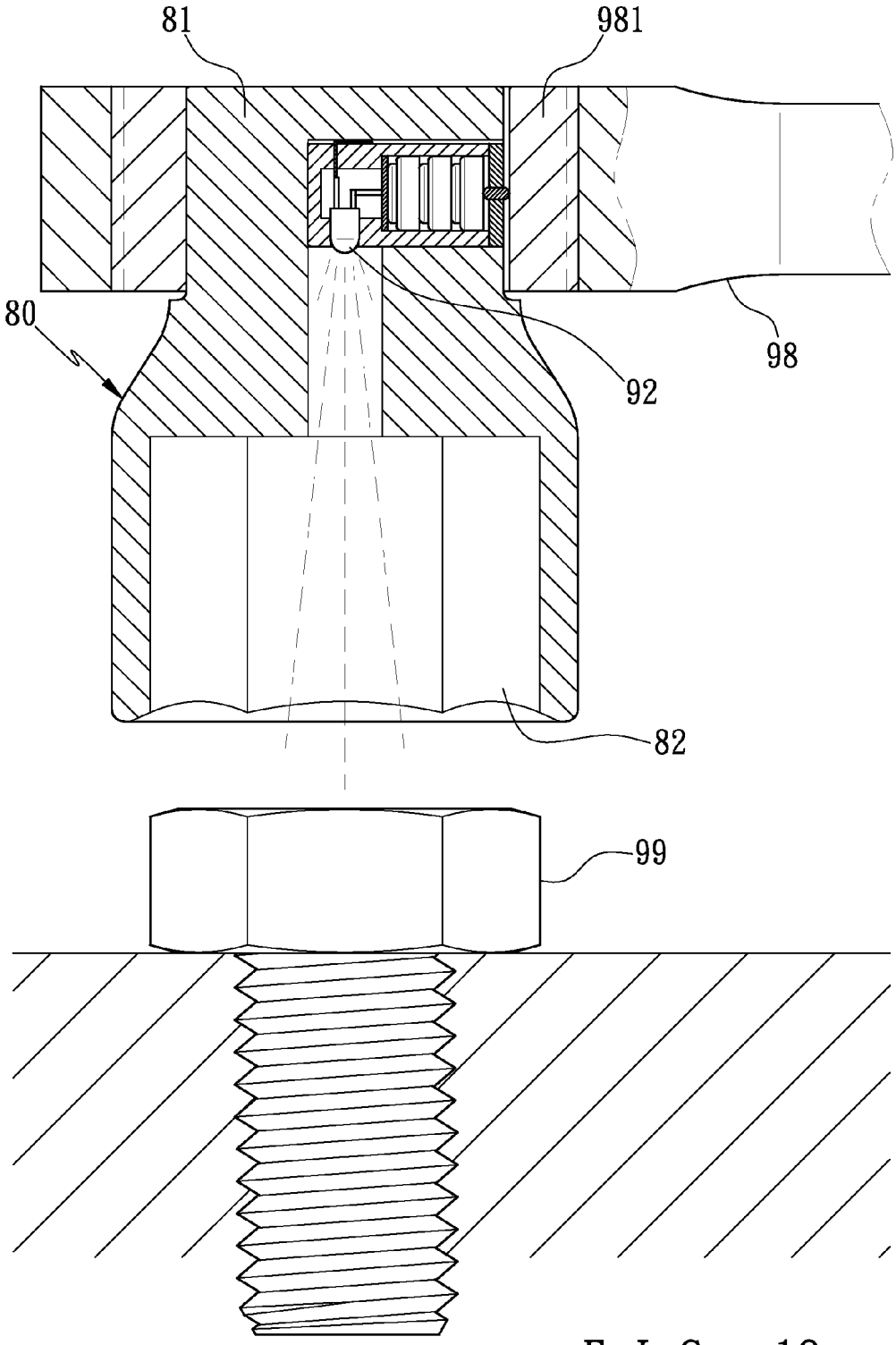
FIG. 18 is a cross sectional view showing the operation of the tool capable of turning on/off the light automatically according to the fourth embodiment of the present invention.

As illustrated in FIG. 18, after the bulb 92 is turned on, the light illuminates a locking member closely without being stopped by an obstacle so that the working area 82 is fitted to a locking member 99 clearly, thereby assembling and disassembling the locking member conveniently.

Figure 19:
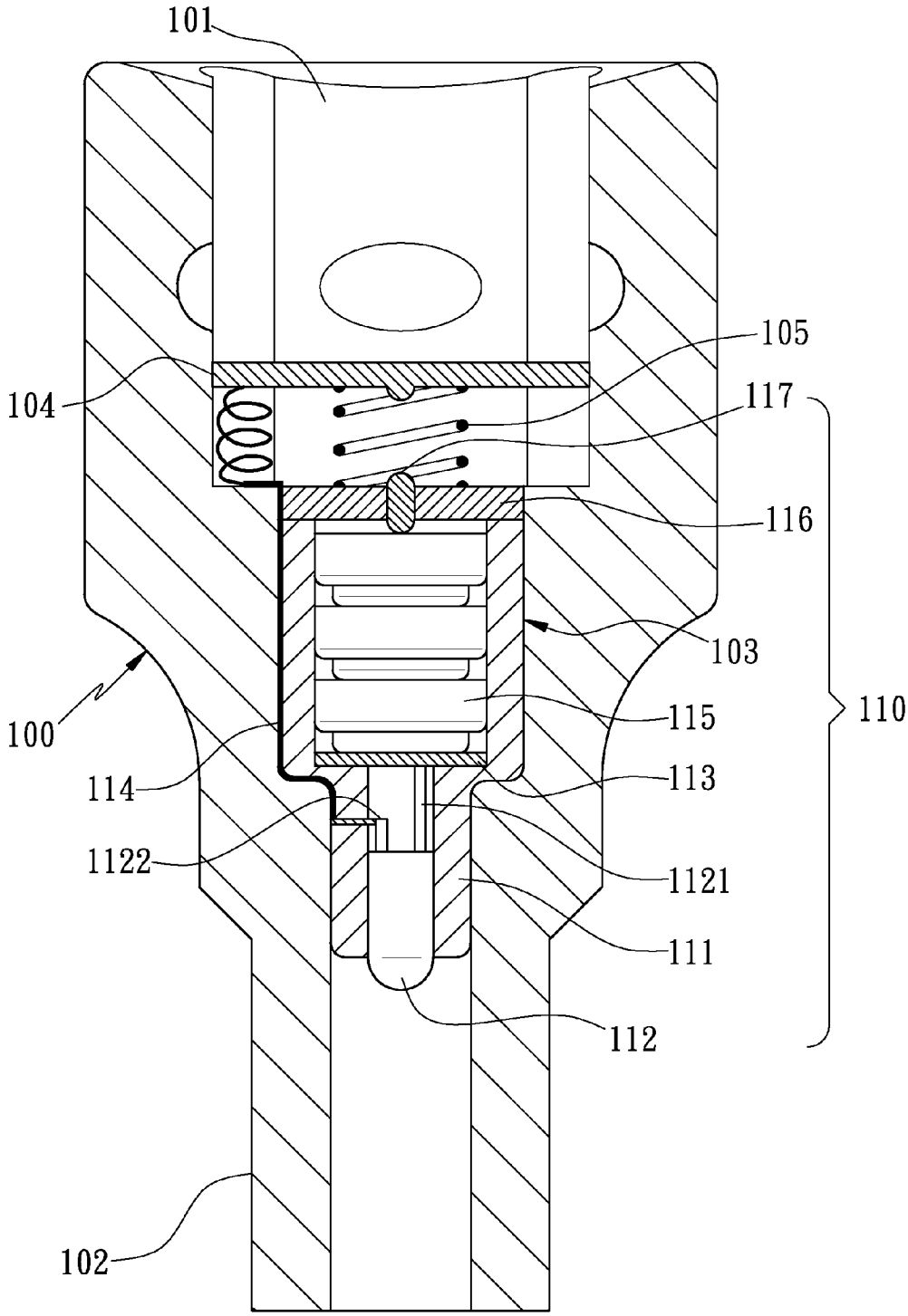
FIG. 19 is a cross sectional view showing the assembly of the tool capable of turning on/off the light automatically according to a fifth embodiment of the present invention.

Referring to FIG. 19, a tool capable of turning on/off a light automatically in accordance with a fifth embodiment of the present invention is a coupling tool and comprises a body 100 and a light module 110, the body 100 includes a fitting area 101 disposed on one end thereof in response to a fitted tool, and a working area 102 mounted on another end to receive a socket tool, the body 100 includes a receiving groove 103 disposed therein to communicate with a front end thereof, and a light module 110 is installed in the receiving groove 103 and includes an insulating seat 111 made of plastic material, the insulating seat 111 includes a bulb 112 and a cell set 115 installed therein, and a first connecting leg 1121 of the bulb 112 couples to one side of a first conducting piece 113. In this embodiment, a second connecting leg 1122 of the bulb 112 connects with a conductible press panel 104 which is located at the fitting area 101 by using a wire 114, and the press panel 104 is supported by a resilient element 105, and the resilient element 105 is a spring, a first electrode of the cell set 115 contacts with another side of the first conducting piece 113 to be conducted to a first connecting leg 1121 of the bulb 112, and the insulating seat 111 includes an insulated cover member 116 arranged on a rear end thereof, the cover member 116 includes a third conducting piece 117 disposed thereon, one end of the third conducting piece 117 contacts with a second electrode of the cell set 115, and another end thereof abuts against the fitting area 101 of the body 100.

Figure 20:
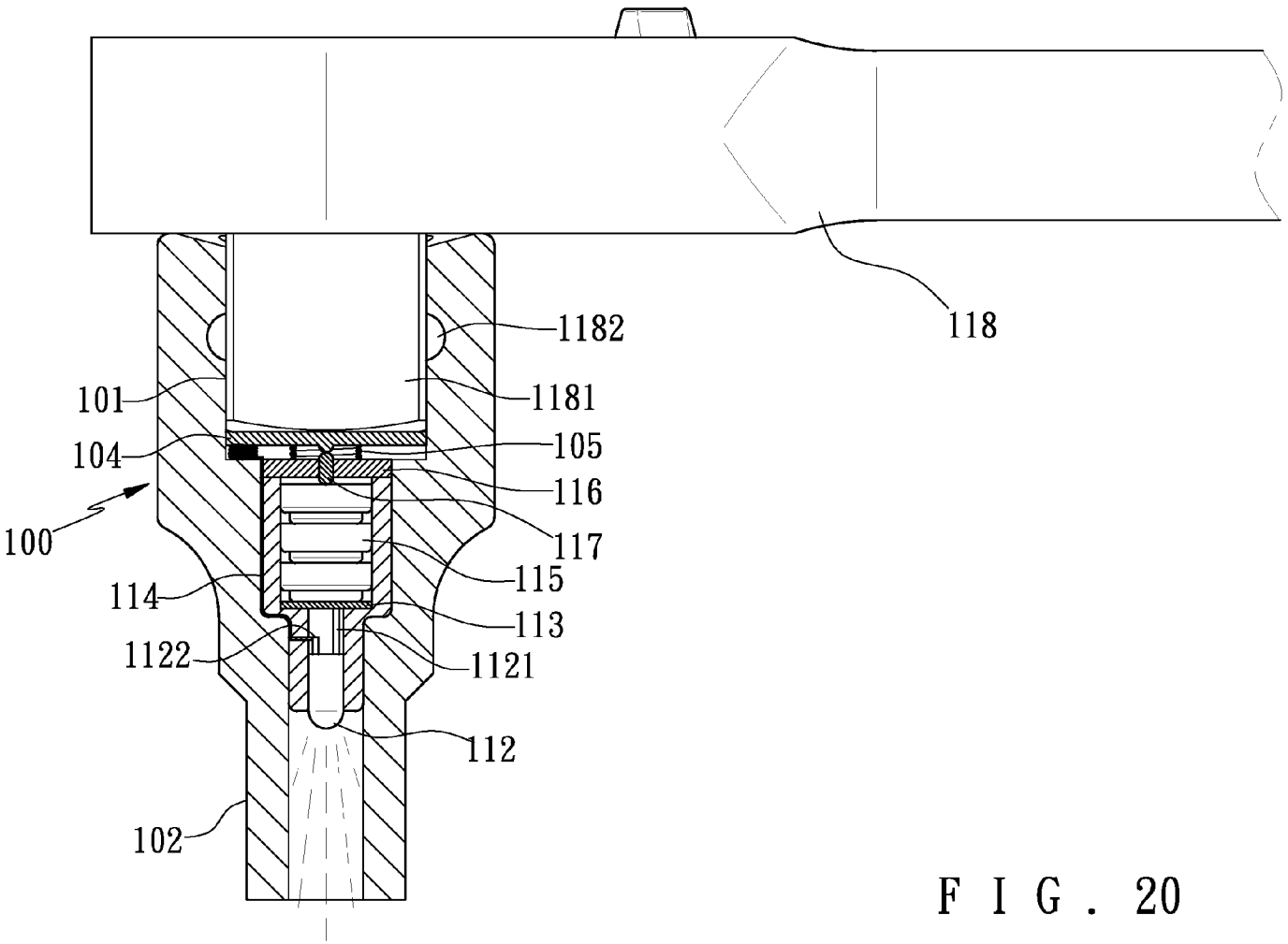

As shown in FIG. 20, when the fitting area 101 of the body 100 is fitted to a socket ratchet wrench 118, a post 1181 of the socket ratchet wrench 118 is fitted to the fitting area 101, and a retaining ball 1182 of the post 1181 is engaged with an inner wall of the fitting area 101, wherein the post 1181 abuts against the conductible press panel 104 so that the press panel 104 contacts with a third conducting piece 117, and the second electrode of the cell set 115 is conducted to the second connecting leg 1122 of the bulb 112 through the third conducting piece 117, the press panel 104, and the wire 114 to generate a conducted circuit to turn on the bulb 112 automatically. Furthermore, when the socket ratchet wrench 118 disengages from the fitting area 101 of the body 100, the press panel 104 returns to an original position to disengage from the third conducting piece 117, such that a break between the second electrode of the cell set 115 and the second connecting leg 1122 of the bulb 112 generates to turn off the bulb 112 automatically.

Figure 21:
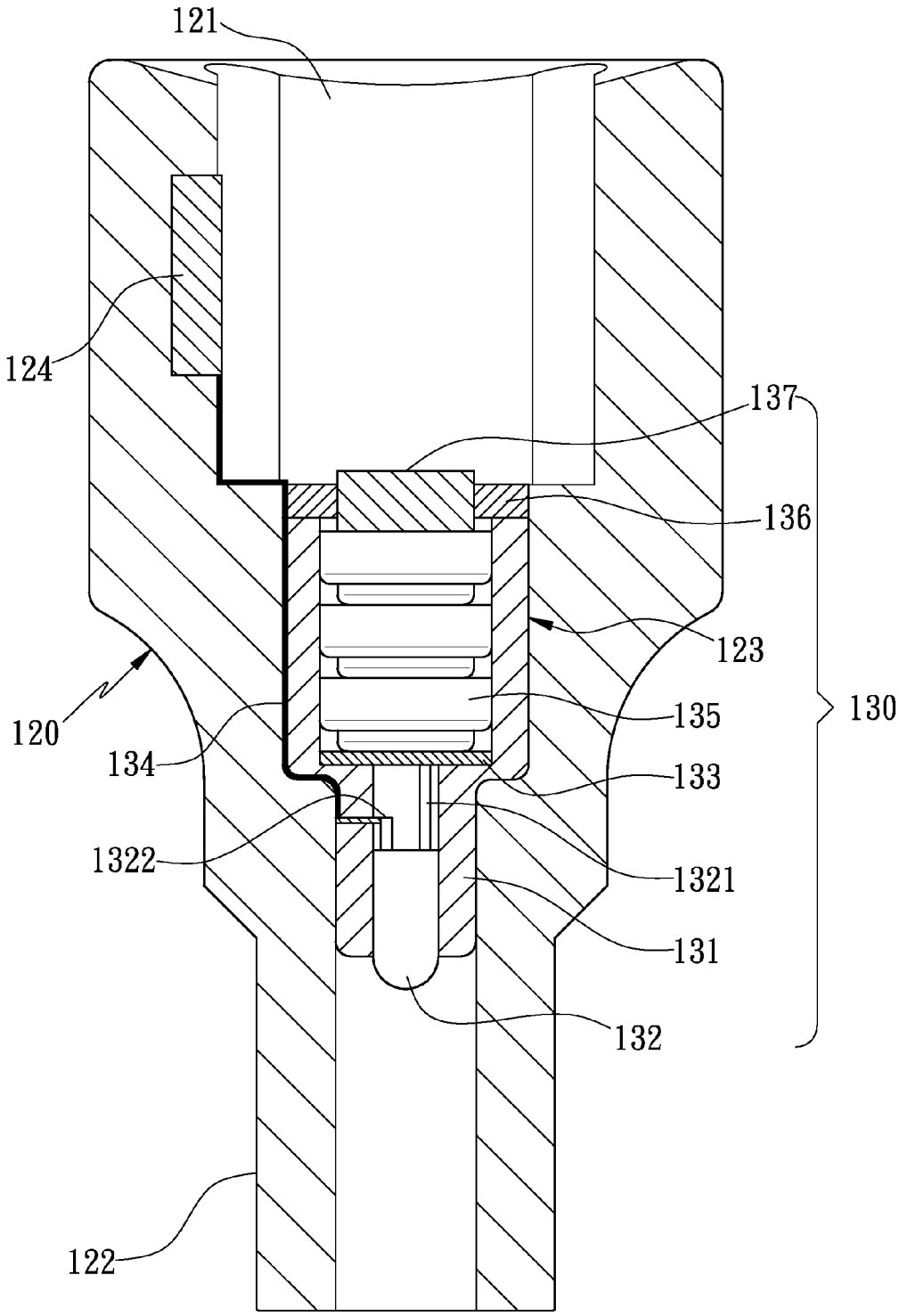
FIG. 21 is a cross sectional view showing the assembly of the tool capable of turning on/off the light automatically according to a sixth embodiment of the present invention.
Figure 22:
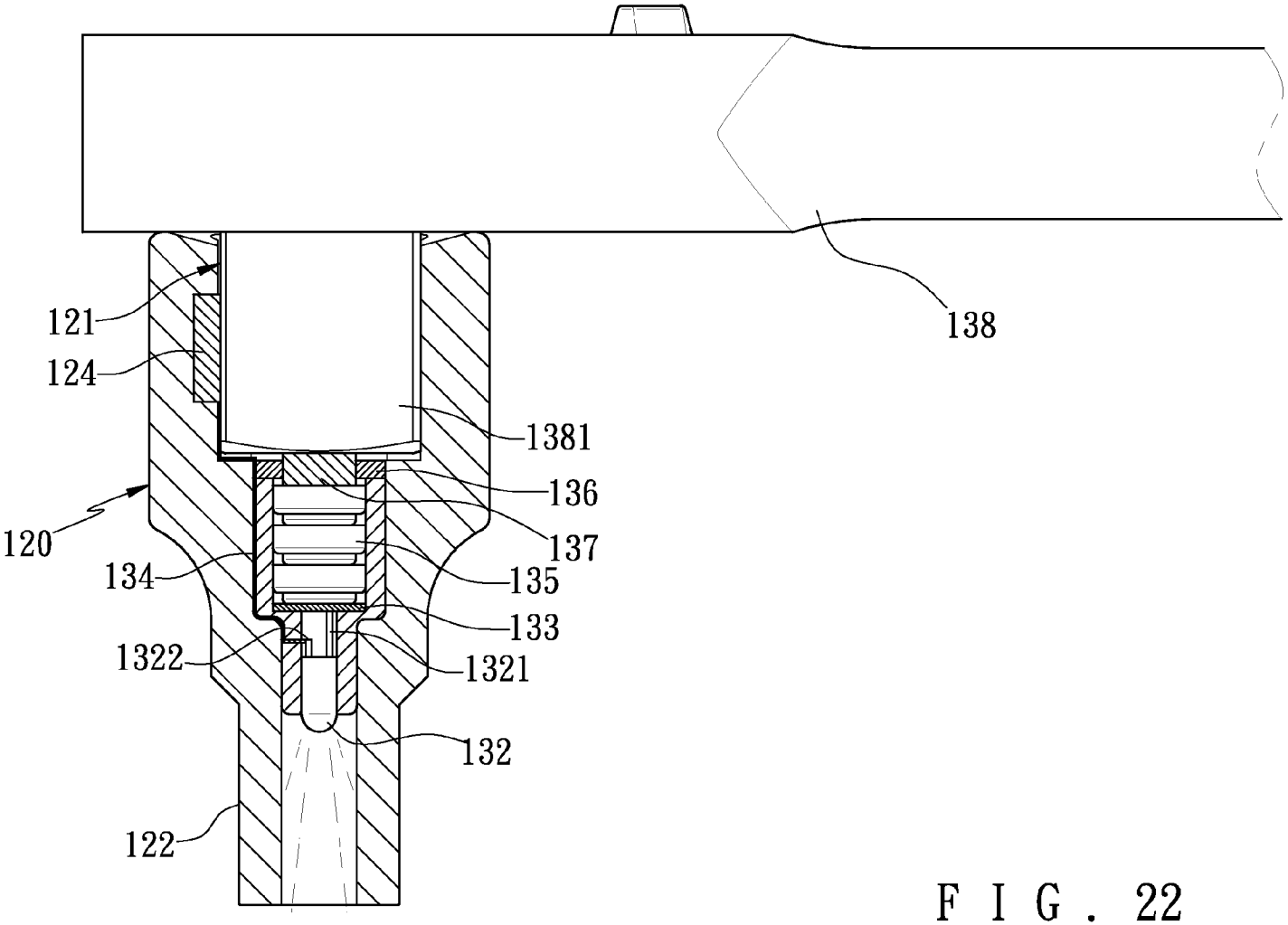

As illustrated in FIG. 21, a tool capable of turning on/off a light automatically in accordance with a sixth embodiment of the present invention is a coupling tool and comprises a body 120 and a light module 130, the body 120 includes a fitting area 121 disposed on one end thereof in response to a fitted tool, and a working area 122 mounted on another end thereof to fit a socket, the body 120 includes a receiving groove 123 disposed therein to communicate with a front end thereof, and a light module 130 is installed in the receiving groove 123 and includes an insulating seat 131 made of plastic material, the insulating seat 131 includes a bulb 132 and a cell set 135 installed therein, and a first connecting leg 1321 of the bulb 132 couples to one side of a first conducting piece 133. In this embodiment, a second connecting leg 1322 of the bulb 132 connects with a conductible first magnetic member 124 which is fixed on a side wall of the fitting area 121 by using a wire 134, and the first magnetic member 124 is wrapped by an insulated material except for its one side surface in response to the tool. Furthermore, a first electrode of the cell set 135 contacts with another side of the first conducting piece 133 to be conducted to the first connecting leg 1321 of the bulb 132, and the insulating seat 131 includes an insulated cover member 136 arranged on a rear end thereof, the cover member 136 includes a conductible first magnetic member 137 disposed thereon, and one end of the second magnetic member 137 contacts with a second electrode of the cell set 135, and another end thereof abuts against the fitting area 121 of the body 120. As shown in FIG. 22, when the fitting area 121 of the body 120 is fitted to a socket ratchet wrench 138, a post 1381 of the socket ratchet wrench 138 is fitted to the fitting area 121 by a magnetic attracting manner to contact with the first and the second magnetic members 124, 137, so that the second electrode of the cell set 135 is conducted to the second connecting leg 1322 of the bulb 132 through the second magnetic member 137, the socket ratchet wrench 138, the first magnetic member 124, and the wire 134 to generate a conducted circuit to turn on the bulb 132 automatically. Furthermore, when the socket ratchet wrench 138 disengages from the fitting area 121 of the body 100, a break between the second electrode of the cell set 135 and the second connecting leg 1322 of the bulb 132 is generated to turn off the bulb 132 automatically.

The invention is not limited to the above embodiment but various modifications thereof may be made. It will be understood by those skilled in the art that various changes in form and detail may made without departing from the scope and spirit of the present invention.

What is claimed is:

1. A tool capable of turning on/off a light automatically comprising:

a body including a fitting area in response to a fitted tool and a receiving groove disposed therein to communicate with a front end thereof; and a light module installed in said receiving groove and including at least one bulb and a cell set, wherein a first electrode of said cell set connecting with a first connecting leg of said bulb, and a second electrode of said cell set connectedly contacting with said fitting area of said body, and when said fitting area of said body is fitted to said fitted tool, a second connecting leg of said bulb conducting to said second electrode of said cell set, wherein said fitting area of said body includes said receiving groove arranged therein to communicate with a front end of said fitting area, and said receiving groove includes said light module installed therein.

2. A tool capable of turning on/off a light automatically comprising:

a body including a fitting area in response to a fitted tool and a receiving groove disposed therein to communicate with a front end thereof; and a light module installed in said receiving groove and including at least one bulb and a cell set, wherein a first electrode of said cell set connecting with a first connecting leg of said bulb, and a second electrode of said cell set connectedly contacting with said fitting area of said body, and when said fitting area of said body is fitted to said fitted tool, a second connecting leg of said bulb conducting to said second electrode of said cell set, wherein said light module further comprises an insulating seat in which said bulb and said cell set are installed therein, and said first electrode of said cell set connects with said first connecting leg of said bulb, said second connecting leg of said bulb extends out of said insulating seat to contact with said body so that said second connecting leg of said bulb conducts to said fitted tool of said fitting area through said body.

3. The tool capable of turning on/off the light automatically, as recited in claim 2, wherein said insulating seat includes a bulb slot and a cell recess disposed therein to receive said bulb and said cell set respectively.

4. The tool capable of turning on/off the light automatically, as recited in claim 2, wherein a first conducting piece is fixed in said insulating seat, and said first connecting leg of said bulb connects with one side of said first conducting piece, and said first electrode of said cell set contacts with another side of said first conducting piece so that said first connecting leg of said bulb conducts to said first electrode of said cell set.

5. The tool capable of turning on/off the light automatically, as recited in claim 2, said second connecting leg of said bulb connects with a second conducting piece which extends out of said insulating seat, and said second conducting piece abuts against an inner wall of said body.

6. The tool capable of turning on/off the light automatically, as recited in claim 2, said cell recess includes an insulated cover member fixed on a rear end thereof; said cover member includes a third conducting piece secured thereon so that one end of said third conducting piece contacts with said second electrode of said cell set, and another end thereof abuts against said fitting area of said body, when said fitting area of said body is fitted to said fitted tool, said fitted tool contacts with said third conducting piece so that said second electrode of said cell set conducts to said second connecting leg of said bulb to generate a conducted circuit, thus turning on said bulb automatically.

7. A tool capable of turning on/off a light automatically comprising:

a body including a fitting area in response to a fitted tool and a receiving groove disposed therein to communicate with a front end thereof; and a light module installed in said receiving groove and including at least one bulb and a cell set, wherein a first electrode of said cell set connecting with a first connecting leg of said bulb, and a second electrode of said cell set connectedly contacting with said fitting area of said body, and when said fitting area of said body is fitted to said fitted tool, a second connecting leg of said bulb conducting to said second electrode of said cell set, wherein said light module further comprises an insulating seat in which said bulb and said cell set are installed therein, and said first electrode of said cell set connects with said first connecting leg of said bulb, said second connecting leg of said bulb connects with a conductible first magnetic member which is fixed on a side wall of said fitting area by using the wire so that said second connecting leg of said bulb conducts to said fitted tool of said fitting area through the wire and said first magnetic member.

8. The tool capable of turning on/off the light automatically, as recited in claim 7, wherein said insulating seat includes a bulb slot and a cell recess disposed therein to receive said bulb and said cell set respectively.

9. The tool capable of turning on/off the light automatically, as recited in claim 7, wherein a first conducting piece is fixed in said insulating seat, and said first connecting leg of said bulb connects with one side of said first conducting piece, and said first electrode of said cell set contacts with another side of said first conducting piece so that said first connecting leg of said bulb conducts to said first electrode of said cell set.

10. The tool capable of turning on/off the light automatically, as recited in claim 7, wherein said insulating seat includes an insulated cover member fixed on the rear end thereof, said cover member includes a conductible second magnetic member secured thereon so that one end of said second magnetic member contacts with said second electrode of said cell set, and another end thereof abuts against said fitting area of said body, when said fitting area of said body is fitted to said fitted tool, said fitted tool contacts with said first and the second magnetic members so that said second electrode of said cell set conducts to said second connecting leg of said bulb to generate a conducted circuit, thus turning on said bulb automatically.

* * * * *